US005960719A

United States Patent [19]

Sunderman et al.

[11] Patent Number: 5,960,719

[45] Date of Patent: Oct. 5, 1999

[54] RAILWAY CAR TRUCK YAW CONTROL DEVICE

[76] Inventors: John R. Sunderman, 3503 Jones St., #301, Omaha, Nebr. 68105; Dale E. Monsell, 120 S. 44th St., Omaha, Nebr. 68131; Robert E. Owen, 1400 S. 84th St., Omaha, Nebr. 68124

[21] Appl. No.: 08/938,179

[22] Filed: Sep. 26, 1997

Related U.S. Application Data

[63] Continuation-in-part of application No. 08/680,061, Jul. 15, 1996.

[51] Int. Cl.[6] ..... B61F 3/00

[52] U.S. Cl. ..... 105/199.3; 105/199.1; 105/453; 384/423

[58] Field of Search ..... 105/199.1, 199.3, 105/453; 384/423, 459, 569

[56] References Cited

U.S. PATENT DOCUMENTS

| | | | |
|---|---|---|---|
| 308,776 | 12/1884 | Lane . | |
| 516,935 | 3/1894 | Kling . | |
| 690,330 | 12/1901 | Tommis . | |
| 740,605 | 10/1903 | Summers . | |
| 1,144,392 | 6/1915 | Summers . | |
| 1,408,371 | 2/1922 | Linton . | |
| 1,921,894 | 8/1933 | Symington | 308/224 |
| 2,111,428 | 3/1938 | Kjolseth | 105/175 |
| 2,227,140 | 12/1940 | Kjolseth | 105/199 |
| 2,407,875 | 9/1946 | Geiger . | |
| 2,422,638 | 6/1947 | Tucker | 105/197 |
| 2,652,244 | 9/1953 | Christenson | 267/9 |
| 2,676,550 | 4/1954 | Burdick | 105/199 |
| 2,696,176 | 12/1954 | Dath | 105/197 |
| 2,698,208 | 12/1954 | Dilg . | |
| 3,045,998 | 7/1962 | Hirst . | |
| 3,376,831 | 4/1968 | Eaton et al. | 105/199 |
| 3,376,958 | 4/1968 | Carr | 188/97 |
| 3,443,528 | 5/1969 | Lipsius et al. | 105/171 |
| 3,670,660 | 6/1972 | Weber et al. | 105/171 |
| 3,712,691 | 1/1973 | Cope | 308/138 |
| 3,731,638 | 5/1973 | Tack | 105/199 A |
| 3,865,045 | 2/1975 | Jones, Jr. | 105/199 C |
| 3,957,318 | 5/1976 | Wiebe | 105/199.3 |
| 3,981,548 | 9/1976 | MacDonnell et al. | 308/226 |
| 4,080,016 | 3/1978 | Wiebe | 105/199.3 |
| 4,228,741 | 10/1980 | Bruner . | |
| 4,712,487 | 12/1987 | Carlson | 105/199.3 |
| 4,955,293 | 9/1990 | Kramer et al. | 105/199.3 |
| 5,386,783 | 2/1995 | Rhen et al. | 105/199.3 |
| 5,682,822 | 11/1997 | Sunderman et al. | 105/199.3 |

FOREIGN PATENT DOCUMENTS

| | | | |
|---|---|---|---|
| 1382426 | 11/1964 | France | 1/1 |

*Primary Examiner*—Robert J. Oberleitner
*Assistant Examiner*—Robert J. McCarry, Jr.
*Attorney, Agent, or Firm*—Zarley, McKee, Thomte, Voorhees & Sease; Dennis L. Thomte

[57] ABSTRACT

A railway car yaw control device includes a housing mounted on the upper surface of a truck bolster with an engagement member biased upwardly from the housing into engagement with a depression formed in a wear plate attached to the bottom of a car body.

5 Claims, 18 Drawing Sheets

RAILWAY CAR TRUCK YAW CONTROL DEVICE

CROSS-REFERENCE TO RELATED APPLICATION

This is a continuation-in-part application of Ser. No. 08/680,061 filed Jul. 15, 1996.

TECHNICAL FIELD

The present invention relates generally to stabilizing and yaw control devices for the trucks of railway cars, and more particularly for an improved side bearing for railway car bodies.

BACKGROUND OF THE INVENTION

Truck hunting due to the conical configuration of the wheel treads causes the rolling wheels and axle assembly of a standard railroad freight car truck to move along a pair of rails in a generally sinusoidal path, causing the railway truck to oscillate laterally and yaw cyclically with respect to the car body about a vertical axis passing through the truck bolster center plate. With controlled truck hunting, the amount of the cyclical lateral motion is relatively small and the wheel flanges will not contact the rails. However, at higher speeds, unstable truck hunting can develop if the frequency of the cyclical motion approaches resonance, wherein the wave pattern of the wheel and axle assembly has the same frequency as the natural roll, sway, and yaw frequencies of the car body. Violent lateral forces are created during uncontrolled truck hunting, which can cause rail damage, excess wear to the truck and car body, as well as heavy lateral impacts between the wheel flanges and rails.

Railway truck side bearings, located laterally outward of the truck center plate, have been utilized in the prior art to provide lateral stability of the car body with respect to a truck. Such side bearings are necessary to limit the amplitude of car body lateral roll motion as can occur under low speed lateral harmonic roll conditions or the degree of tilt of the car body as can occur with the car slowly transversing superelevated track curves.

Typical roller side bearings in the prior art include rollers carried within a housing mounted on the railway truck bolster. The roller extended above the open top of the housing for rolling engagement when contacted by a wear plate on the bottom of the car body. In this way, the car body was stabilized laterally outwardly of the truck center plate on the bolster, while permitting the truck to rotate about a vertical centerline of the bolster center plate, to permit normal truck movement along the railroad track.

In an effort to improve upon the conventional side bearings, so as to increase truck hunting stability as well as car body lateral roll stability, various devices have been installed between the car body and truck bolster to replace or supplement the conventional roller side bearing. Such devices have ordinarily taken the form of elastomeric blocks or other elements forming a constant contact bearing to modify the rotational swiveling resistance characteristics of the truck as well as affecting the lateral roll stability of the car body.

As a result of prior art truck stabilizing devices, the truck swiveling resistance was usually characterized by a gradually increasing opposed force up to a point of relative sliding displacement between the support surfaces. As the truck continued to swivel, a substantially constant sliding frictional restraint was maintained up to the point of maximum truck swiveling. Because of the relative sliding displacement, the return truck motion was opposed by a frictional sliding resistance. Also, because of the reverse elastic deformation of the elastomeric block, some additional truck swiveling motion was required to restart the truck in a straight running position.

SUMMARY OF THE INVENTION

It is therefore a general object of the present invention to provide a novel and improved railway car truck yaw control device, while also providing the necessary lateral car body roll stability.

Another object is to provide a yaw control device which creates a relatively high initial resistive force opposing truck swiveling, which rapidly decreases with increasing swiveling displacement.

A further object of the present invention is to provide a truck side bearing with desired swiveling resistant torque characteristics, but which is economical to manufacture and of simple mechanical design.

These and other objects of the present invention will be obvious to those of ordinary skill in the art.

The railway car yaw control device bearing of the present invention includes a housing mounted on the upper surface of a truck bolster with an engagement member biased upwardly from the housing into engagement with a depression formed in a wear plate attached to the bottom of a car body.

DESCRIPTION OF THE PREFERRED EMBODIMENT

Figure 1:
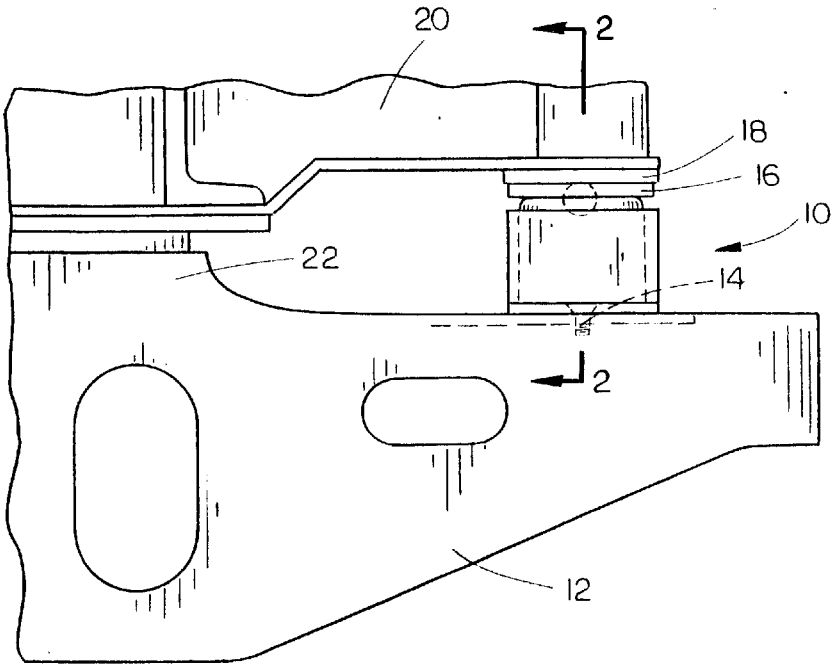
FIG. 1 is an end elevational view showing the side bearing of the present invention mounted between a railway truck and a car body.

Referring now to the drawings, in which the same or similar parts are identified with the same reference numeral and more particularly to FIG. 1 the side bearing assembly of the present invention is designated generally at 10 and which is supported atop a bolster 12 of a railway truck and is secured thereto by threaded fastener 14. Side bearing assembly 10 includes a top plate 16 having an upper surface in frictional contact with a bottom surface of a wear plate 18 mounted on the bottom of rail car body 20. The rail car body 20 is supported by a center plate bearing portion 22 of bolster 12. Although this invention will be described with reference to a conventional truck bolster and center plate support system, it will be understood that the invention may also be utilized in other car body support applications such as intermodal cars or other car configurations, as well as alternative truck configurations such as single axle trucks. Because the following drawings will show side bearing assembly 10 utilized on a conventional three piece truck, other components not shown, but well known in the field, include spring groups mounted in a pair of side frames to support the opposed longitudinal ends of bolster 12, as well as journaled wheel sets which rests on railroad tracks to support each side frame of the truck.

Figure 2:
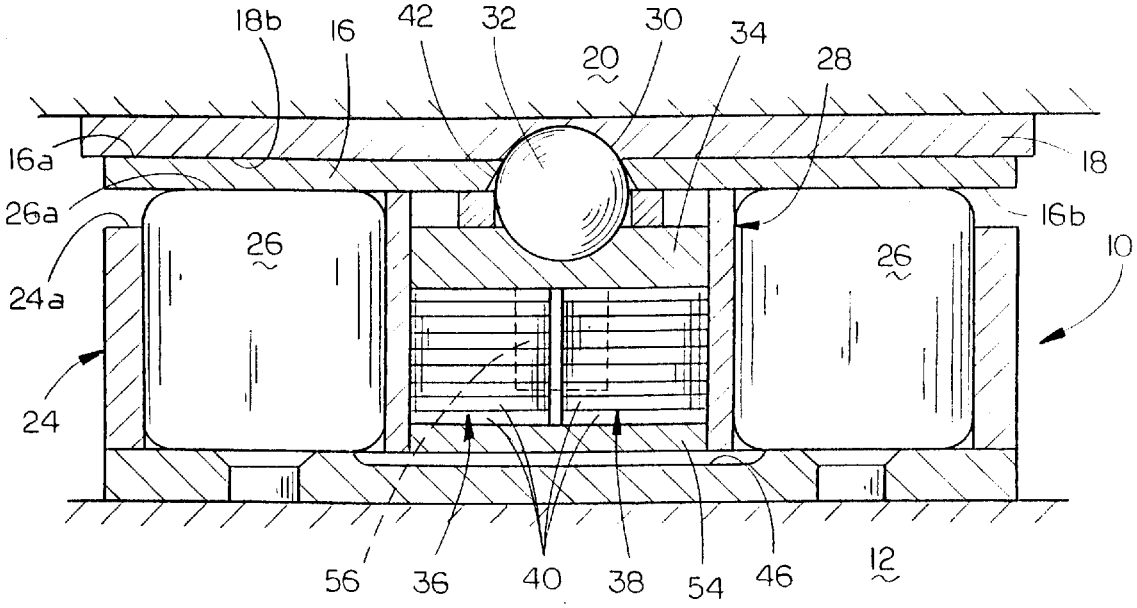
FIG. 2 is a sectional view taken at lines 2—2 in FIG. 1.

Referring now to FIG. 2, side bearing assembly 10 includes a base housing 24 having an open upper end which will receive a pair of elastomeric compressible blocks 26 as well as a ball assembly carriage 28, the carriage 28 depending from the bottom face 16*b* of top plate 16. The upper face 16*a* of top plate 16 is in flush frictional engagement with the lower face 18*b* of wear plate 18.

A generally spherical depression 30 is formed in the lower surface 18*b* of wear plate 18 and is formed to receive a ball 32 therein, to restrain slidable movement of the wear plate 18 relative to top plate 16. A ball support member 34 is slidably mounted within carriage 28 for vertical movement, and is biased upwardly by two stacks 36 and 38 of disk springs 40. An aperture 42 formed through top plate 16 allows an upper surface of ball 32 to project outwardly through top plate 16 as support member 34 biases the ball 32 upwardly.

Figure 3:
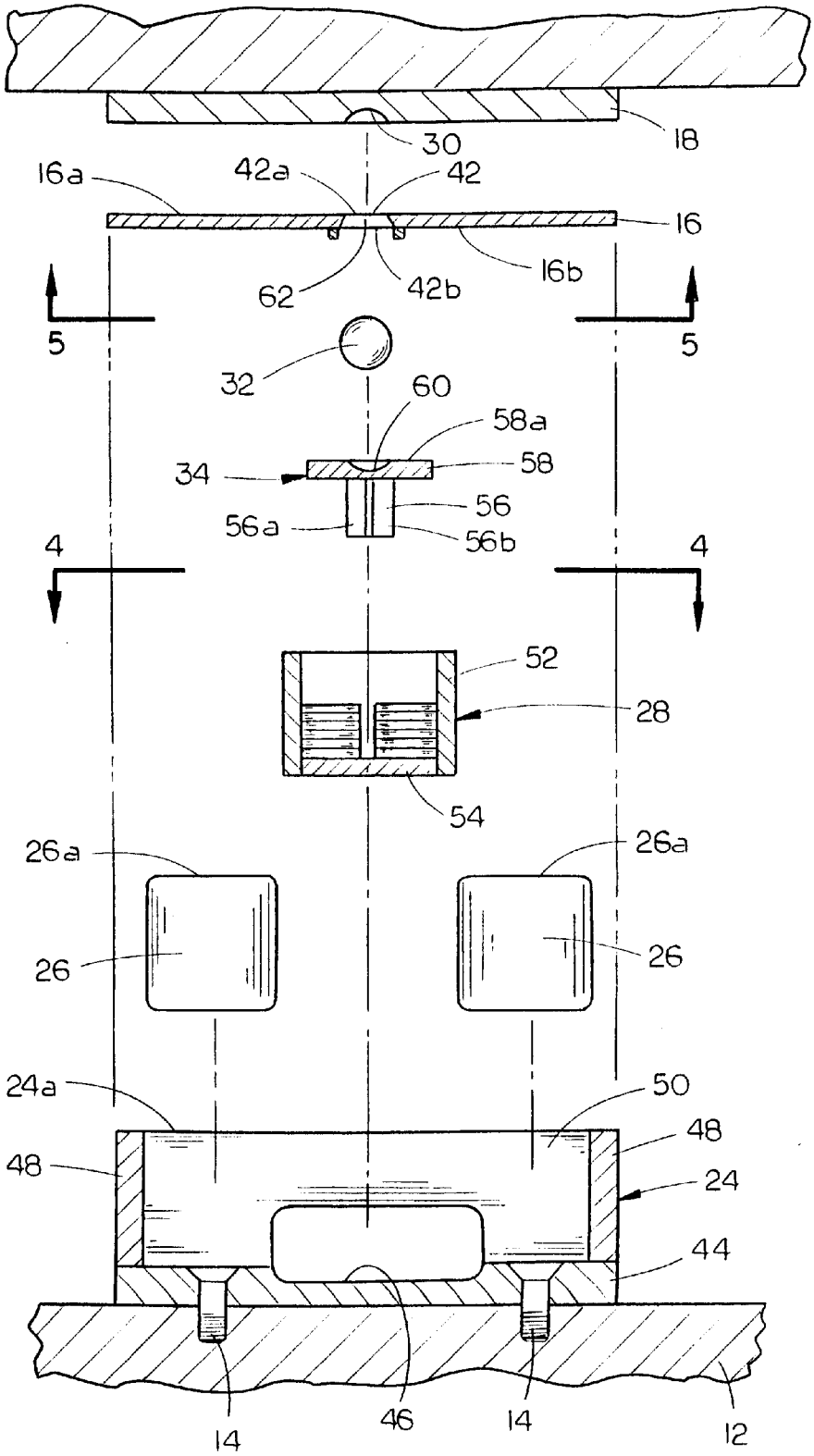
FIG. 3 is an exploded view of the sectional view of FIG. 2.

Referring now to FIG. 3, it can be seen that base housing 24 includes a base plate 44 mounted to bolster 12 with fasteners 14. A transversely extending channel 46 is formed in the upper surface of base plate 44 to permit a predetermined amount of downward movement of carriage 28 as elastomeric blocks 26 are compressed (see also FIG. 2). Vertically oriented dynamic forces from the roll and sway of the car body will cause such dynamic forces to occur.

A pair of vertical end plates 48 and opposing vertical side plates 50 complete base housing 24, to form a generally rectangular box having an open upper end.

Elastomeric blocks 26 have a height which is greater than the height of end plates 48 and side plates 50, such that a top surface 26*a* of blocks 26 projects upwardly beyond the upper edge 24*a* of base housing 24 (as shown in FIG. 2).

Figure 4:
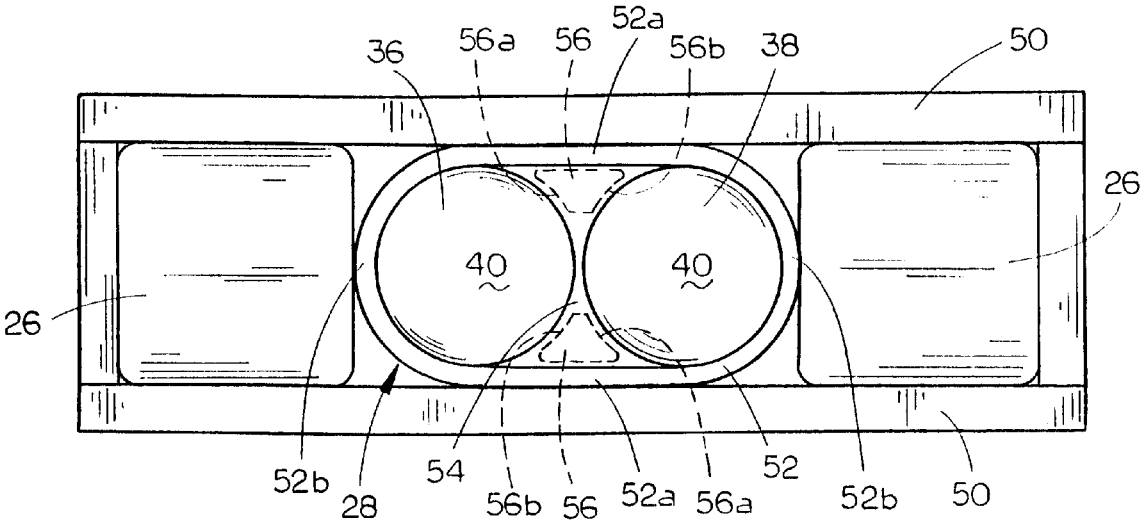
FIG. 4 is a plan elevational view taken at lines 4—4 in FIG. 3.
Figure 5:
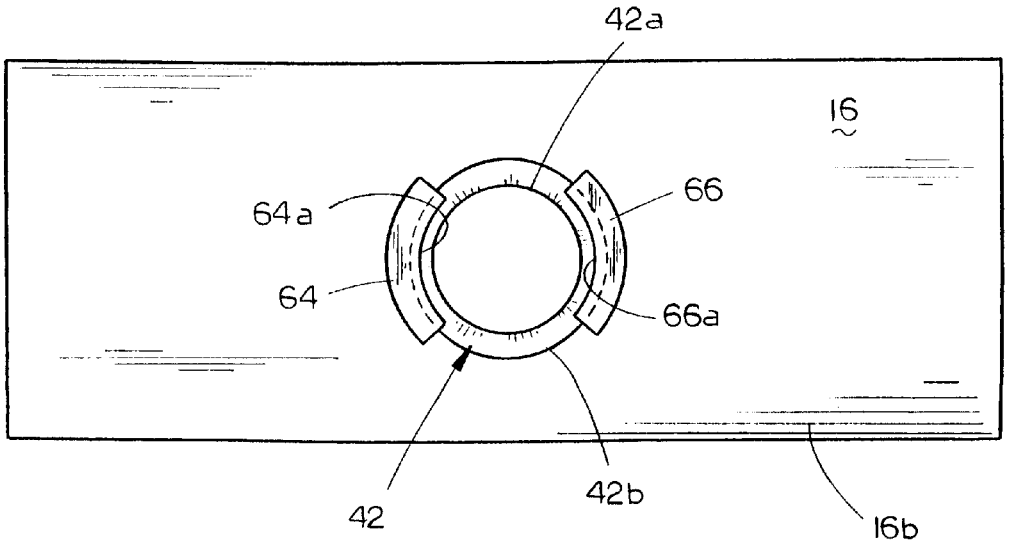
FIG. 5 is a plan view taken at lines 5—5 in FIG. 3.
Figure 24:
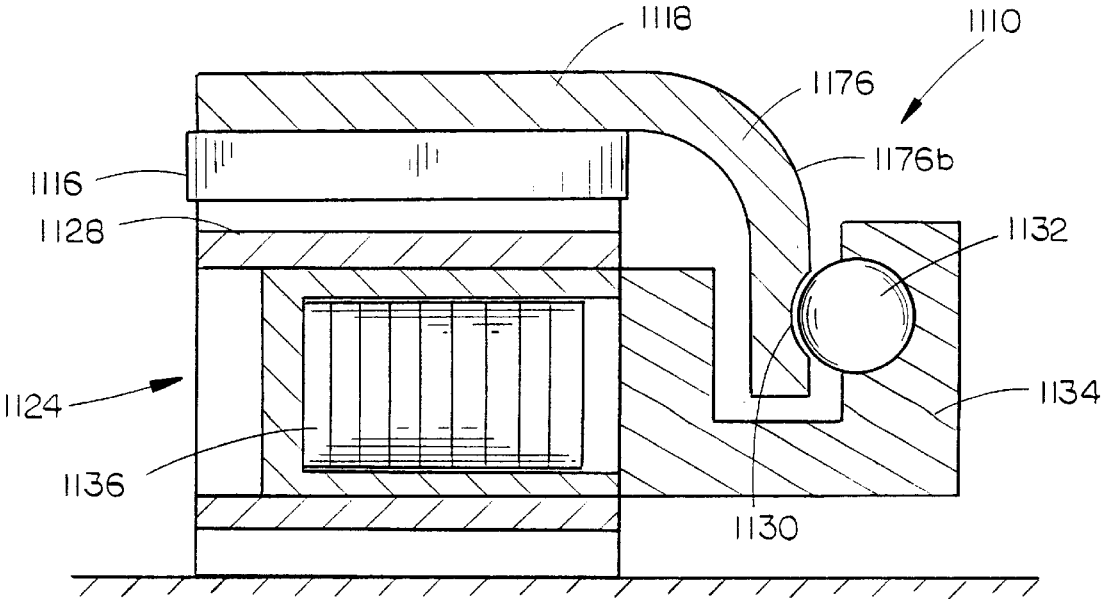
FIG. 24 is an end sectional view of an eleventh embodiment of the invention.

Referring now to FIGS. 24, carriage 28 is generally oval in top plan view. Side wall 52 extends upwardly from an oval bottom plate 54, continuously around the entire perimeter thereof, to form carriage 28 with an open upper end. Carriage 28 has a width, as measured between longitudinal portions 52*a* of side wall 52 which fits closely between base side panels 50, to permit vertical slidable movement. The length of carriage 28, as measured between end portions 52*b* of perimeter side wall 52 is designed to fit snugly between elastomeric blocks 26. The oval shape of carriage 28 with semicircular end portions 52*b* permits two stacks 36 and 38 of disk springs 40 to be operably mounted therein. A pair of generally triangular guide legs 56 are shown in broken lines in FIG. 4, which extend downwardly into carriage 28 between stacks 36 and 38, from support plate 58 of ball support member 34 (see FIGS. 2 and 3). Two vertical surfaces 56*a* and 56*b* of guide legs 56 are curved to a radius matching the radius of disks 40, to further maintain disks 40 in their respective vertical stacks 36 and 38.

Referring once again to FIGS. 2 and 3, ball support member 34 includes a generally oval shaped support plate 58 having dimensions to be received within carriage 28, for vertical slidable movement therein. The upper surface 58*a* of support plate 58 has a spherical depression 60 formed therein of a radius matching the radius of ball 32, to receive and support ball 32 therein. As shown in FIG. 2 (in hidden lines) guide legs 56 have a length less than the height of disk stacks 36 and 38 when the disks are in a noncompressed state. As will be described in more detail hereinbelow, the distance between the lower end of guide legs 56 and the upper surface of carriage bottom plate 54 is preferably at least as great as the depth of depression 30 in wear plate 18.

Although top plate 16 is shown separated from carriage 28, in operation, carriage 28 is affixed to the lower face 16*b* with ball 32, ball support assembly 34, and disk springs 40 therein. Aperture 42 has a tapered side wall 62, such that the diameter of aperture 42 at top plate upper face 16*a* has a smaller diameter than the diameter of aperture 42 at top plate lower face 16*b*. In additional, the diameter 42*a* of aperture 42 is less than the diameter of ball 32, while the lower diameter 42*b* of aperture 42 is greater than the diameter of ball 32, such that ball 32 will project upwardly through aperture 42 beyond upper diameter 42*a*.

A pair of arcuate guide members 64 and 66 depend from the lower surface 16*b* of top plate 16 on diametric sides of aperture 42. Preferably, guide members 64 and 66 have an inward side wall 64*a* and 66*a* respectively with a radius slightly greater than the radius of ball 32 and are positioned spaced apart slightly greater than the diameter of ball 32 and concentric with aperture diameters 42*a* and 42*b*. In this way, as ball 32 is biased downwardly into carriage 28, guide members 64 and 66 will maintain ball 32 in alignment with aperture 42, to return the ball to the position shown in FIG. 2 upon realignment of the dimple 30 with aperture 42.

In operation, the upwardly biased ball 32 engages depression 30 in wear plate 18 to act as a detent mechanism in combination with the restraint provided by the friction between top plate 16 and wear plate 18. The friction produced between top plate 16 and wear plate 18 provides the primary restraint against swivel movement of the truck, while the detent mechanism supplements this frictional force. In this way, the detent mechanism acts as a centering device, and increases the initial resistance to truck hunting, while eliminating the initial resistance as the truck swivels on a curved railroad track or the like. The relative horizontal movement between the body mounted wear plate 18 and the truck mounted top plate 16 caused by the truck swiveling movement occurring as a rail car transits a curved railroad track will cause the ball 32 to retract into carriage 28, overcoming the bias of spring disks 40. As noted above, support member 34 is preferably capable of retracting downwardly into carriage 28 a distance sufficient to permit ball 32 to lower completely below the upper surface of top plate 16.

While the side bearing assembly 10 of the present invention has been shown throughout FIGS. 1–5 in its preferred embodiment, many modifications, substitutions, and equivalent components may be incorporated within the scope of the invention. For example, elastomeric blocks 26 and disk springs 40, shown in FIG. 2, may be a wide range of equivalent biasing devices, including hydraulic or pneumatic cylinders, or other types of springs and/or compressible members.

In a nominal state, a standard constant contact side bearing (hereinafter "CCSB") exerts a longitudinal resistance of approximately 500–3,000 pounds. Typically, a heavier car requires a greater resisting force. This resisting force is a function of a vertical spring load pushing the top plate of the side bearing against a wear plate, and the friction code efficient of the top plate and wear plate materials as they slide against one another. A standard CCSB on a 120 ton rail car might have a spring preload force of approximately 6,000 pounds, with its top plate and wear plate materials having a friction co-efficient of approximately 0.4, thereby creating a longitudinal resistance of 2,400 pounds per side bearing (4,800 pounds per truck).

As noted above, the side bearing assembly of the present invention has two operating states: one for straight running track, and one for curved track. The side bearing assembly generates a minority of its longitudinal resistance through the wear plate and top plate resistance, and a majority of the longitudinal resistance through a roller, ball, piston, or other cam positioned in a detent located on the wear plate. A side bearing assembly device on a 120 ton rail car can use a spring preload for the top plate mechanism of 2,000 pounds interacting with materials having a friction code efficient of 0.4, to thereby produce a longitudinal resistance of 800 pounds (versus 2,400 pounds for the standard CCSB). If 2,400 pounds of longitudinal resistance per CCSB is ideal for controlling truck hunting in a 120 ton car on straight running track, the side bearing assembly of the present invention can be designed to generate the remaining 1600 pounds of longitudinal resistance by the spring loaded cam positioned within the detent. As noted above, a variety of spring biasing means are available to produce such forces.

On curved track, the cam will retract out of the detent so as to reduce its longitudinal resistance by a factor of approximately 0.25 to 5. Using the example of a 120 ton car, the retracted cam can be designed to exert only 500 pounds during curving (versus the 1600 pounds in the detent). This total, when added to the other pounds of resistance between the wear plate and top plate, combine for a longitudinal resistance of 1300 pounds (versus the 2,400 pounds for the standard CCSB) in a curve.

The side bearing assembly of the present invention utilizes spring biasing apparatus for the top plate that approximates ⅕ to ⅗ the preload forces of a standard CCSB, thereby reducing the amount of potential longitudinal resistance that occurs when the rail car leans into the device on a curve. During curving, the detent mechanism is retracted (either partially or fully) and will generally be isolated from the vertical forces of the leaning rail car, and will therefore not add significant additional longitudinal resistance to the truck as weight from the leaning rail car increases.

Figure 7:
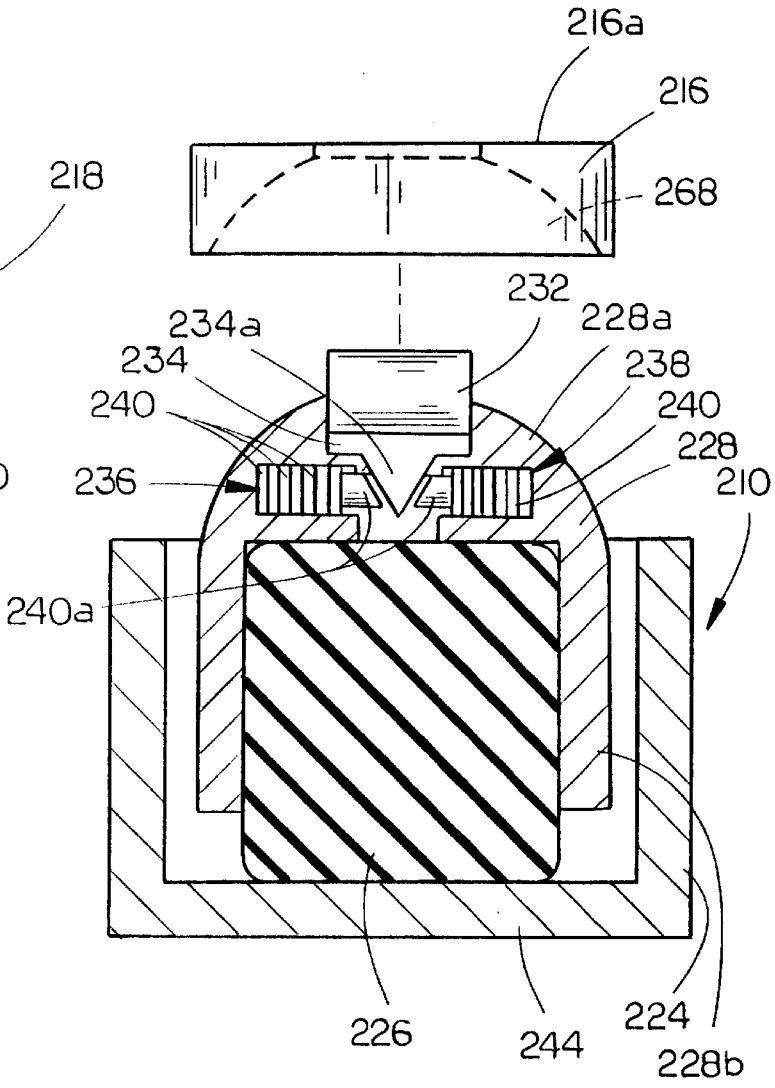
FIG. 7 is an end sectional view of the invention shown in FIG. 6.
Figure 6:
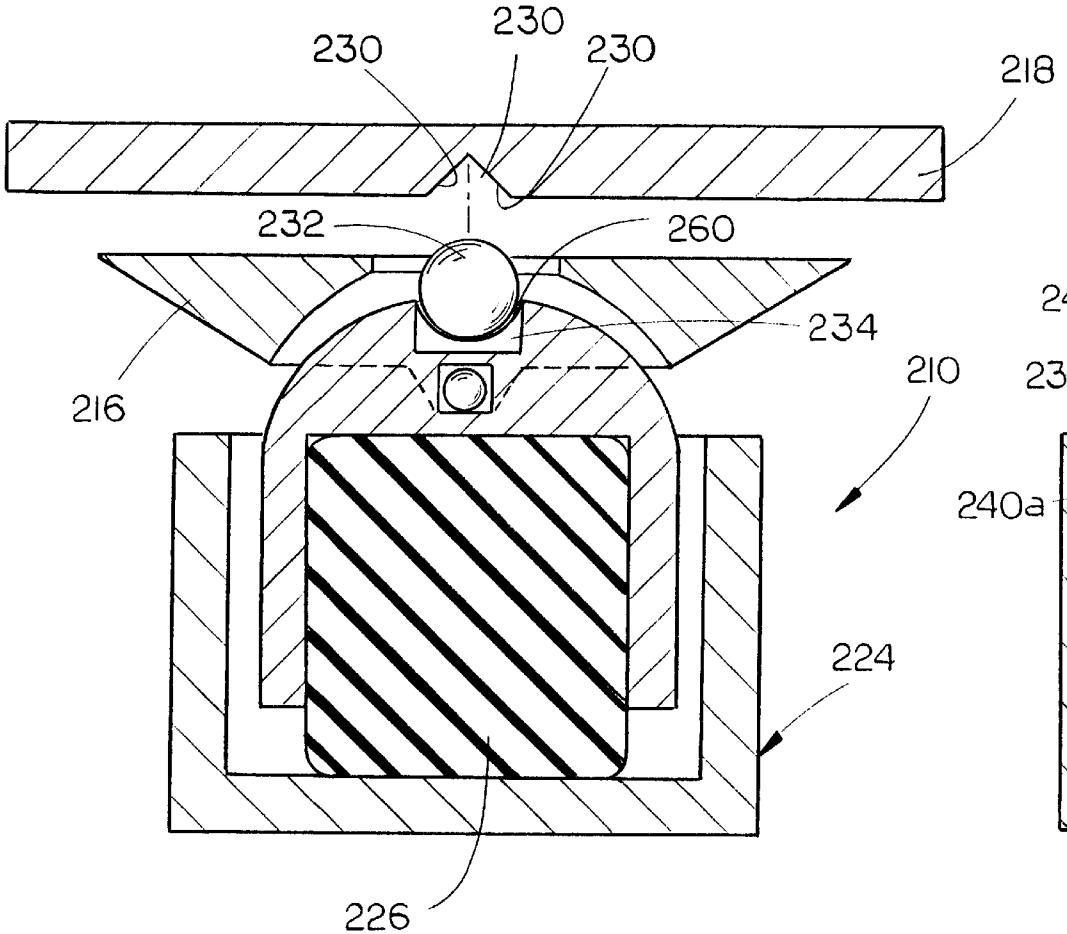
FIG. 6 is a side sectional view of a second embodiment to the invention.

Referring now to FIGS. 6 and 7, a second embodiment of the side bearing; assembly is designated generally at 210 and includes a base housing 224 mounted either on the bolster, or bottom of the rail car body, as discussed with respect to side bearing assembly 10. Throughout the application, two types of biasing apparatus will act within the side bearing assembly. As noted above, these biasing forces may be in the form of springs, compressible elastomeric materials, hydraulic and/or pneumatic cylinders, and other equivalent apparatus. For simplicity, it should be understood that the term "spring" as used throughout this application includes all of these alternative equivalent devices.

Carriage 228 includes a head portion 228*a* which supports the cam 232, and a foot portion 228*b* which retains the carriage spring 226. Carriage spring 226 resiliently supports carriage 228 spaced above housing base plate 244.

Top plate 216 includes a flat upper surface 216*a* and a truncated spherical cup 268 in the bottom surface thereof. As shown in FIGS. 6 and 7, carriage head portion 228*a* is generally spherical in shape to match the spherical shape of cup 268 and rotatably engage top plate 216.

Cam 232 is shown in FIGS. 6 and 7 as a cylindrical roller, supported within a matching cylindrical depression 260 of the cam support member 234. A wide variety of other shapes for cam 232 could be utilized with equally effective results. For example a spherical ball was shown in side bearing assembly 10. A cone-shaped member (shown in FIG. 9) could also be utilized. Similarly, an arcuate projection (shown in FIG. 11) acts in a similar fashion as a cam within a detent. Thus, throughout this application, the term "cam" is intended to refer to any equivalent structure which may be urged into a detent to bias against sharing movement of the detent with the cam.

Side bearing assembly 10 utilize stacks of disk springs 40 to bias the cam 32 upwardly into the detent depression 30. Side bearing assembly 210 utilizes a pair of transversely oriented opposing spring mechanisms 236 and 238, each spring mechanism including a spring 240 and a bearing 240*a*. As shown in FIG. 7, cam support member 34 includes a lower portion 234*a* with opposing sloped surfaces which are acted upon by the sloped surfaces of spring bearings 40*a* to bias cam support member 34 upwardly. As with spring 226, is intended to include all types of biasing members, including elastomeric members and cylinders as well as mechanical springs.

Referring now to FIG. 6, wear plate 218 includes a detent depression 230 for receiving the detent cam 232. While side bearing assembly 210 utilizes an elongated valley with flat sloped walls, the shape of detent depression 230 may also take on a wide variety of equivalent configurations. For example, side bearing assembly 10 utilizes a spherical depression 30 for receiving detent cam 32, which also has a spherical shape. Detent depression 230 could also take on a cylindrical shape, a conic shape, or virtually any other shape which has opposing side walls 230*a* and 230*b* which are sloped such that sheer movement of the wear plate relative to the top plate will cause the detent cam 232 to be displaced from the detent depression 230. While the slope will vary with respect to the desired amount of force required to move the cam out of the detent depression, in most cases, the slope of detent side walls 230*a* and 230*b* will be between 20° and 45°. For those detent depressions having a variable slope, the greater slope angle will be located in contact with the cam when the cam is at rest and centered in the detent depression, and would slope at a lesser angle as the side wall approached the surface of the wear plate in contact with the top plate.

Figure 8:
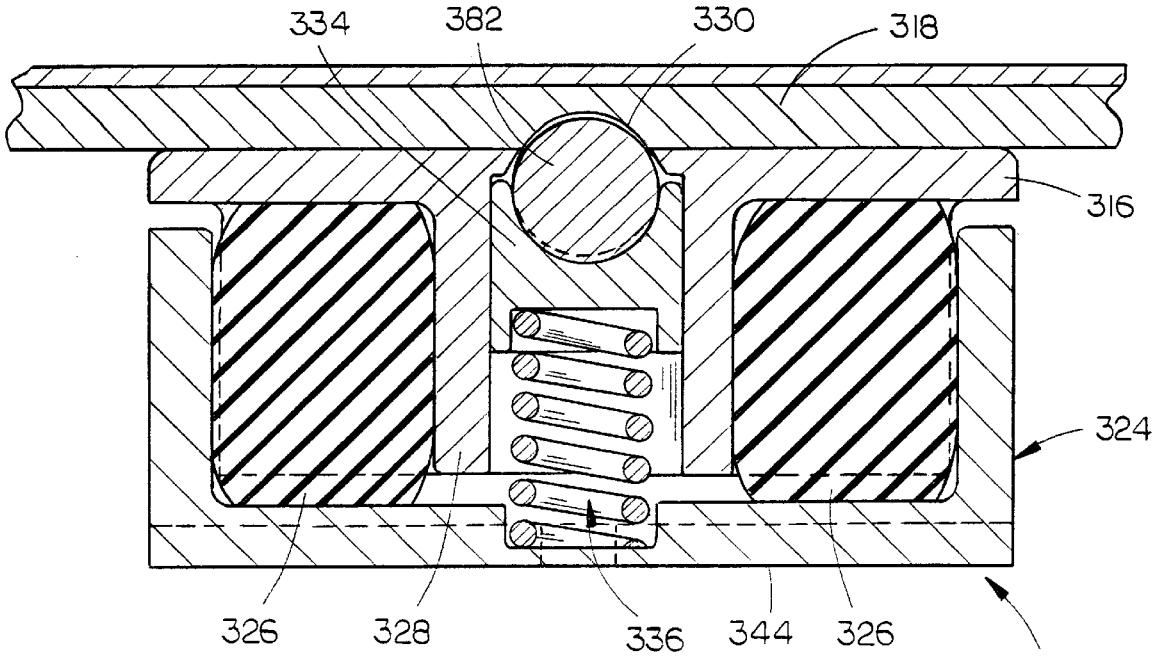
FIG. 8 is a side sectional view of a third embodiment to the invention.
Figure 9:
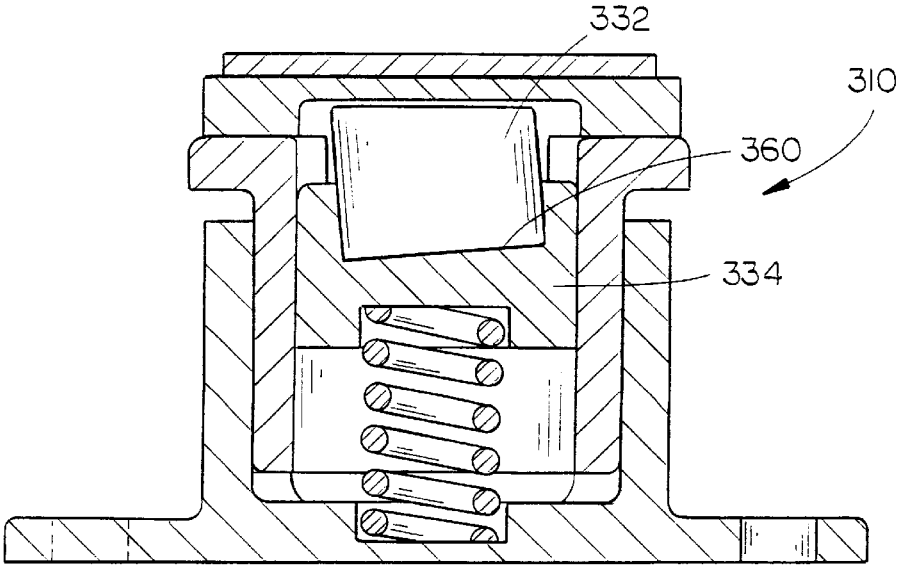
FIG. 9 is an end sectional view of the invention shown in FIG. 8.

Referring now to FIGS. 8 and 9, a third embodiment of the side bearing assembly is disclosed generally at 310. As with previous versions, side bearing assembly 310 includes a housing 324 with a pair of carriage springs 326 on opposing sides of a central carriage 328. Top plate 316 is mounted to the upper end of carriage 328, and is supported above housing 324 by carriage springs 326.

Side bearing assembly 310 includes a detent spring mechanism 336 which directly contacts housing base plate 344 to bias the cam support member 334 and cam 332 upwardly into detent depression 330 in wear plate 318. As shown in FIG. 9, cam 332 is in the shape of truncated cone, and cam support member 334 includes a similar and corresponding cone-shaped cam depression 360.

Figure 10:
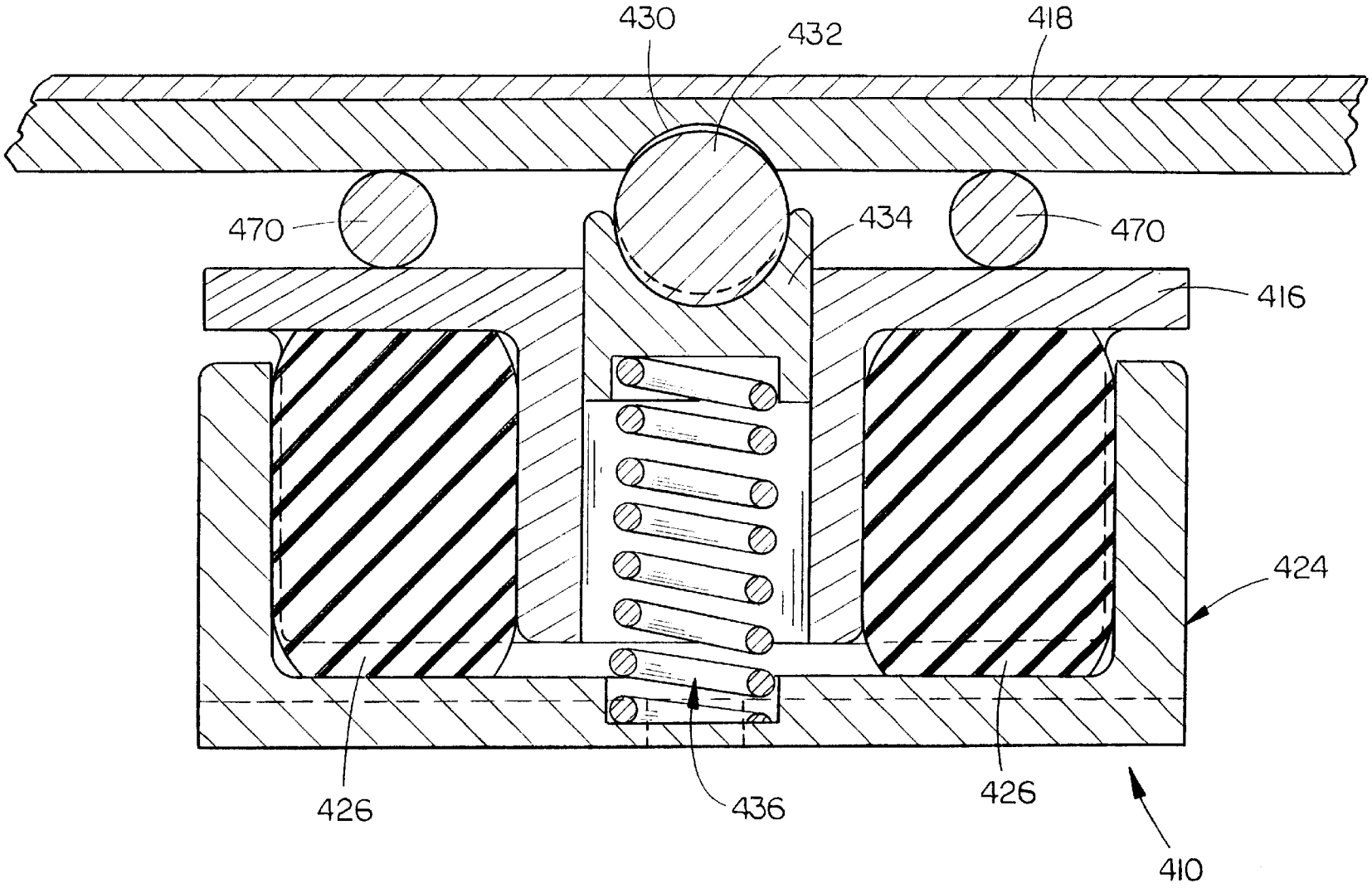
FIG. 10 is a side sectional view of a fourth embodiment to the invention.

Referring now to FIG. 10, a fourth embodiment of the side bearing assembly is designated generally at 410, and includes the same housing 424, carriage springs 426, spring mechanism 436, cam 432 and cam support member 434 as side bearing assembly 310. However, the contact between wear plate 418 and top plate 416 is indirect, through a pair of rollers 470. Rollers 470 would reduce the frictional engagement between wear plate 418 and top plate 416, in a conventional fashion. Top plate 416 is modified to permit the cam support member 434 to project upwardly beyond the upper surface of top plate 416, such that cam 432 will engage detent depression 430 in wear plate 418.

Figure 11:
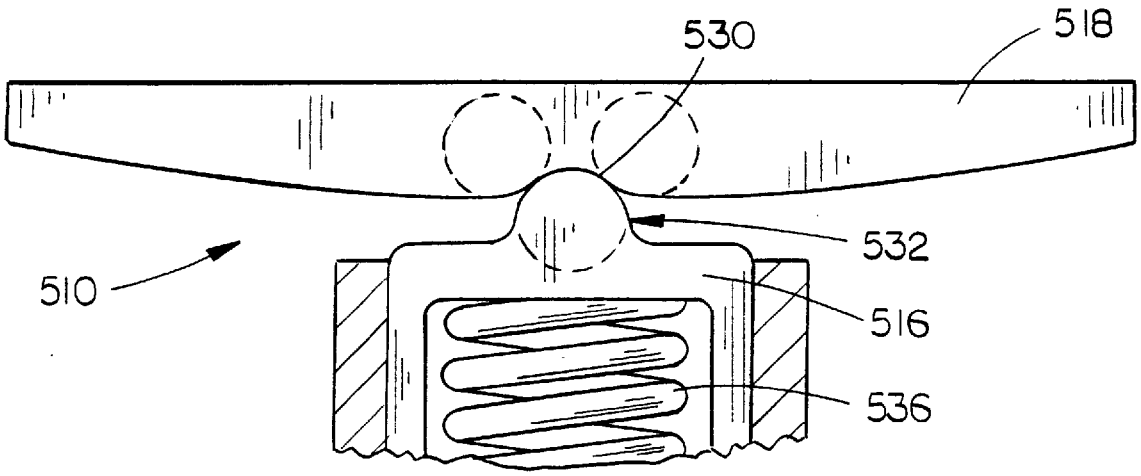
FIG. 11 is a side sectional view of a fifth embodiment to the invention.
Figure 12:
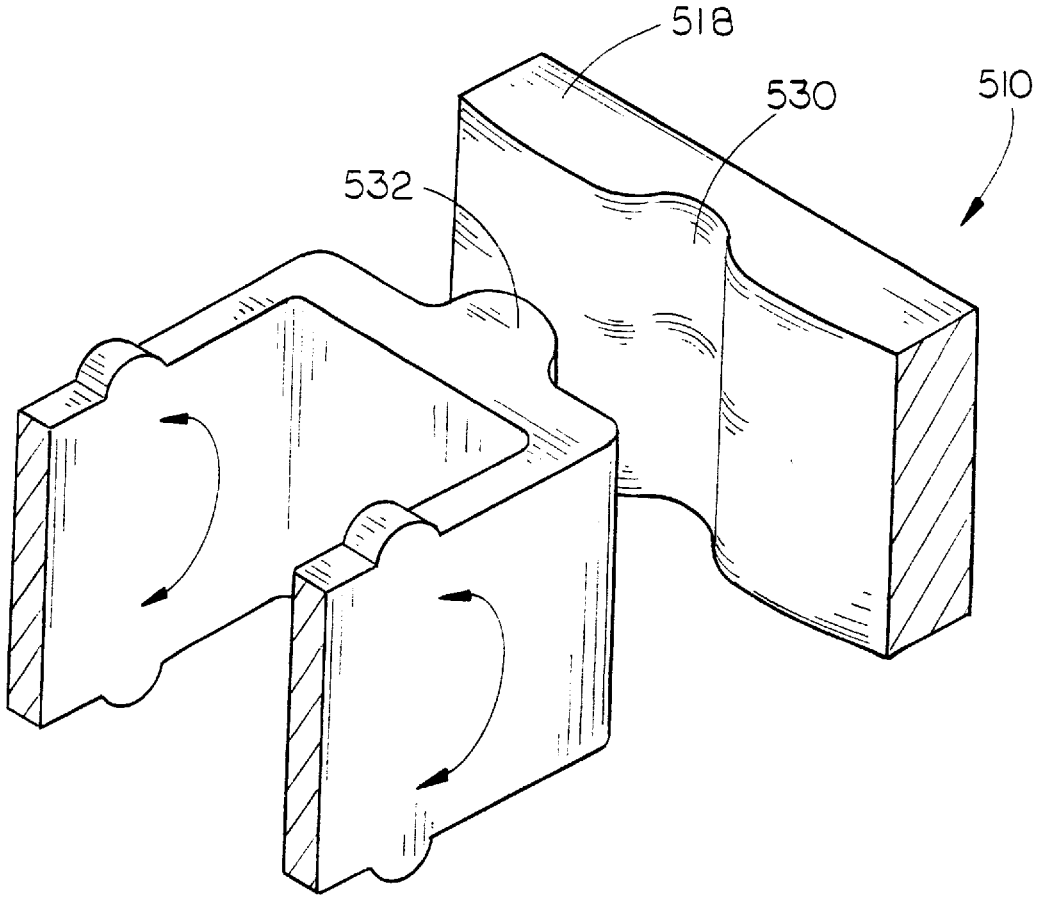
FIG. 12 is an exploded perspective view of the top plate housing and wear plate of the invention shown in FIG. 11.

Referring now to FIGS. 11 and 12, a fifth embodiment of the side bearing assembly is designated generally at 510. In this embodiment, the cam 532 is a semi-cylindrical projection integrally formed on the upper surface of top plate 516. Spring mechanism 536 biases the cam 532 upwardly into the detent depression 530 on wear plate 518.

Figure 13:
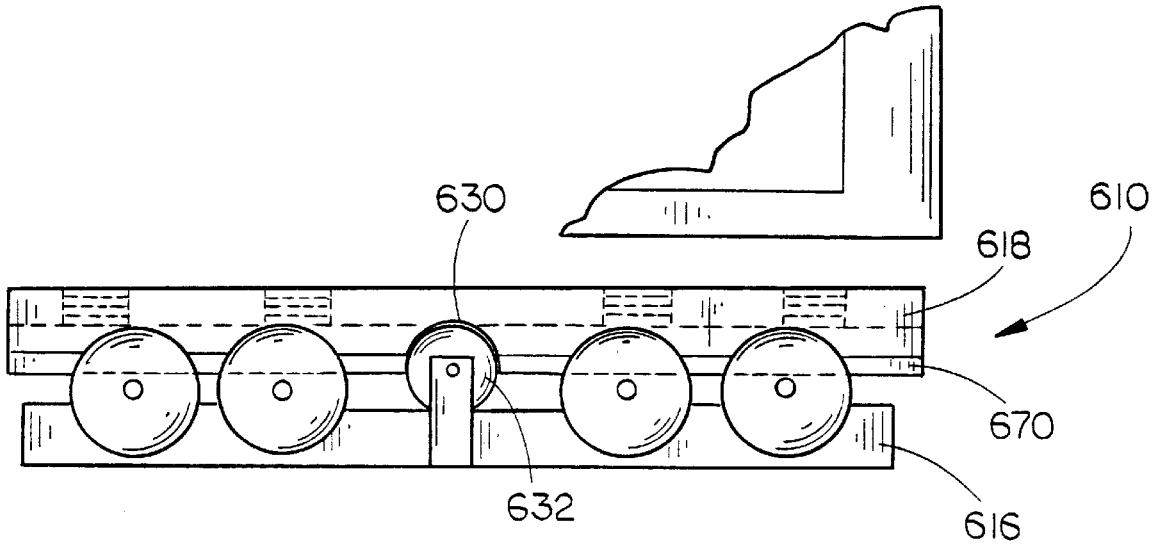
FIG. 13 is a side sectional view of a sixth embodiment to the invention.
Figure 14:
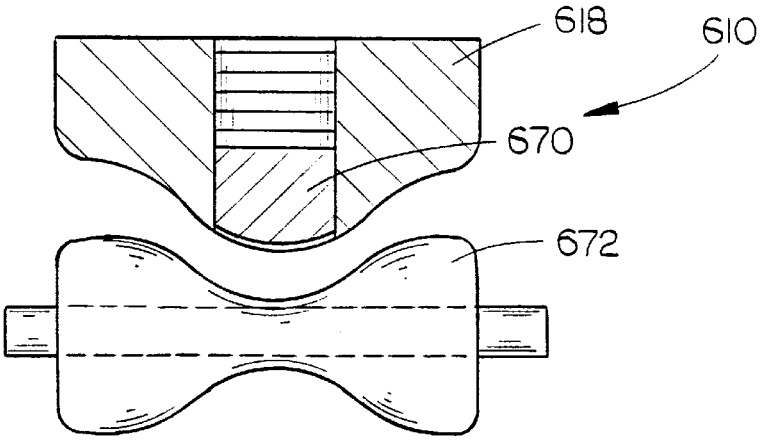
FIG. 14 is an end sectional view of the invention shown in FIG. 13.
Figure 15:
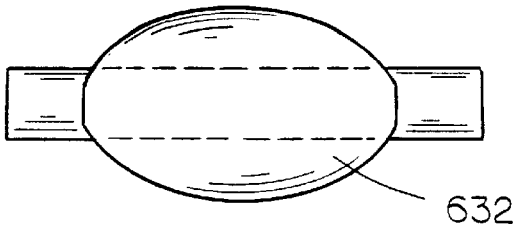
FIG. 15 is an end elevational view of an alignment roller of the invention of FIG. 13.

FIGS. 13–15 disclose a sixth embodiment of the side bearing assembly, designated generally at 610, wherein the wear plate 618 includes a spring loaded elongated detent member 670 with a centrally disposed detent depression 630, the cam roller being rotatably but rigidly affixed to top plate 616. A plurality of stationery rollers 672 serve as bearings on wear plate 618, and have an outer configuration following that of the detent member 670 and wear plate 618. Top plate 616 could also be spring loaded as in previous embodiments of the invention. FIG. 15 is a front view of the cam roller 632 which will engage the detent depression 630.

A widely used side bearing arrangement utilizes a simple housing which contains two loose rollers, the housing attached to the bolster, and a rubber pad attached to the car body. The rollers and rubber pad do not come into contact, except during severe rocking events, when they provide a rolling "go solid" point.

Figure 16:
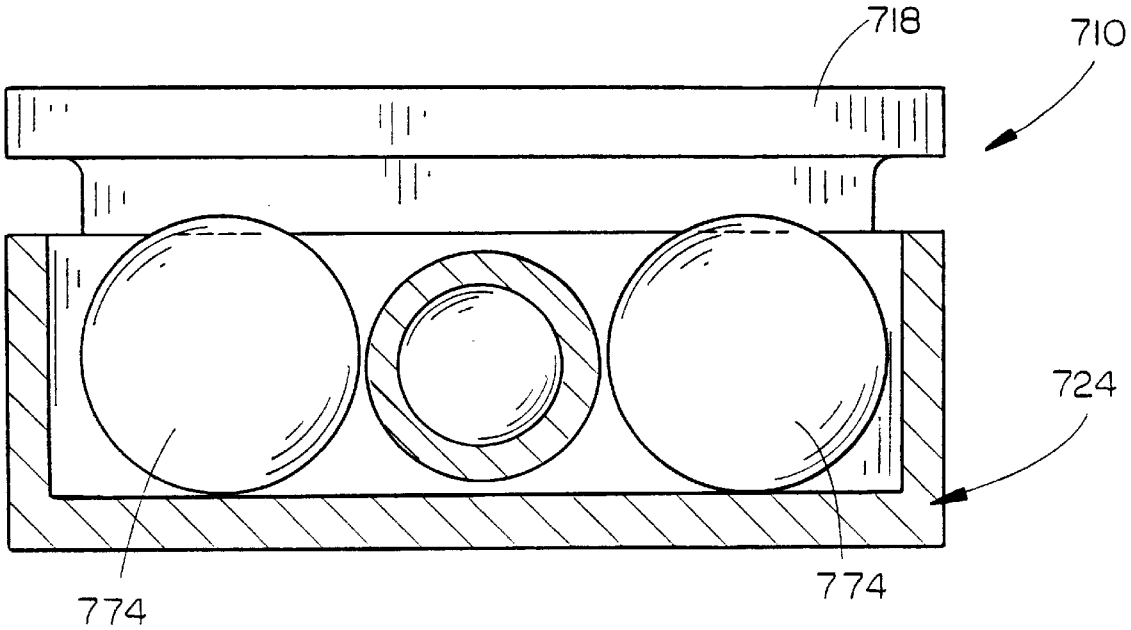
FIG. 16 is a side sectional view of a seventh embodiment to the invention.
Figure 17:
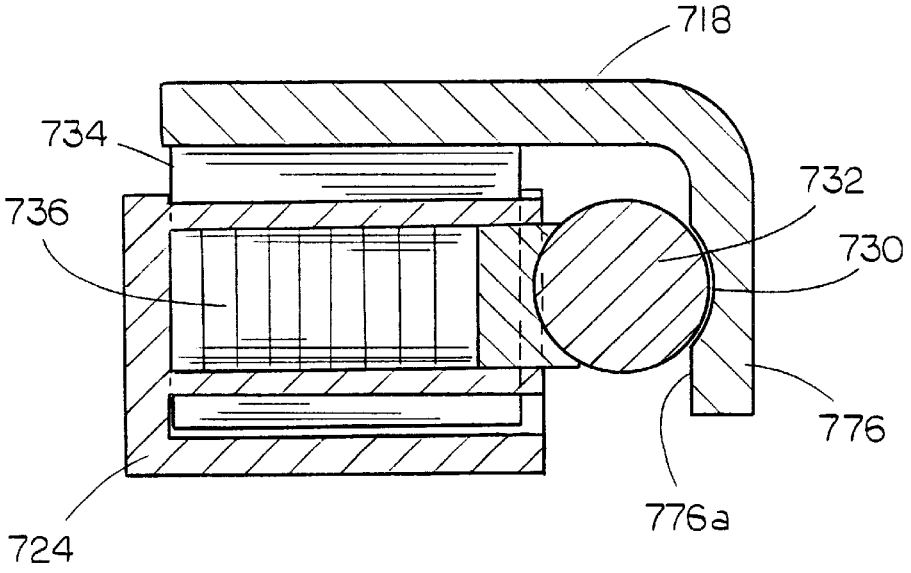
FIG. 17 is an end sectional view of the invention shown in FIG. 16.

A seventh embodiment of the invention is designated generally at 710 in FIGS. 16 and 17, and modifies this conventional side bearing arrangement with a horizontally oriented centering mechanism.

Side bearing assembly 710 therefore includes a housing 724 attached to the bolster on the truck, and a wear plate or soft pad 718 mounted on the under side of the car body. A pair of large diameter rollers 774 are loose within the open topped housing 724, and will contact the wear plate 718 during a severe rocking event.

As shown in FIG. 17, wear plate 718 includes a depending leg 776, which is spaced transversely outwardly from housing 724, generally orthogonal to the longitudinal axis of rollers 774. A horizontally oriented spring mechanism 736 will bias the cam 734 outwardly against an inward surface 776*a* of wear plate leg 776. The detent depression 730 is formed in wear plate leg inward surface 776, for controlling truck hunting.

Figure 18:
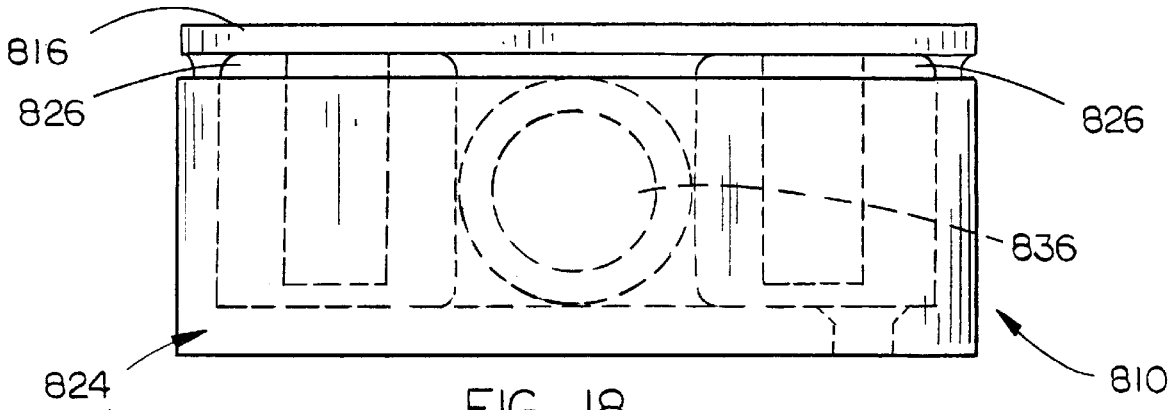
FIG. 18 is a side elevational view of an eighth embodiment to the invention.
Figure 19:
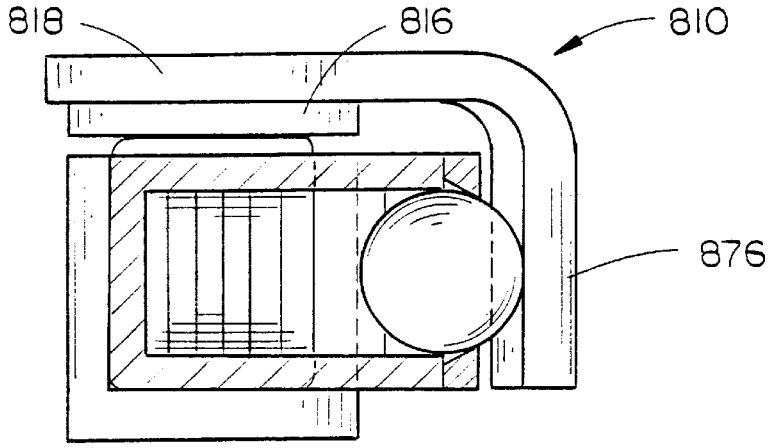
FIG. 19 is an end elevational view of the invention shown in FIG. 18.
Figure 20:
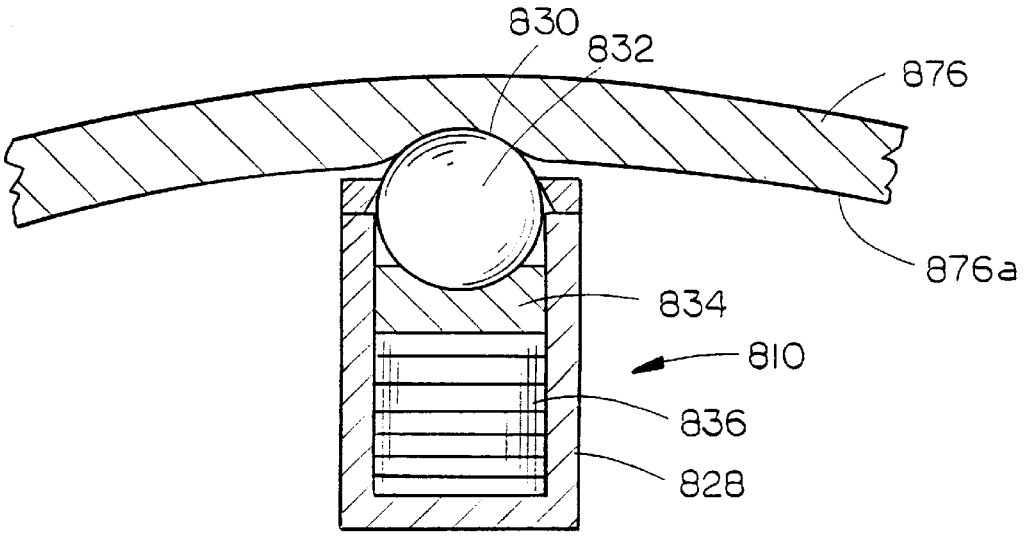
FIG. 20 is a top plan sectional view of the invention shown in FIGS. 18 and 19.

FIGS. 18–20 disclose an eighth embodiment of the side bearing assembly, which is designated generally at 810. Side bear assembly 810 is similar to side bearing assembly 710, in the use of a horizontally oriented centering mechanism. As shown in FIG. 18, housing 824 includes a pair of carriage springs 826 spaced on opposing sides of the cam spring mechanism 836, and projecting upwardly beyond the upper end of housing 824. Carriage springs 826 will support top plate 816 thereon, which will frictionally engage wear plate 818, as shown in FIG. 19.

Carriage 828 is shown in FIG. 20, and encloses spring mechanism 836, cam support member 834, and cam 832, in a horizontal orientation. As with side bearing 710, wear plate 818 includes a leg 876 depending outwardly spaced transversely from housing 824, as shown in FIG. 19. Preferably, wear plate leg 876 is curved slightly so that the inward surface 876*a* is maintained at a constant distance from the projecting end of carriage 828. Detent depression 830 is formed on the inward surface 876*a* of wear plate leg 876, in the same fashion as side bearing assembly 710.

Figure 21:
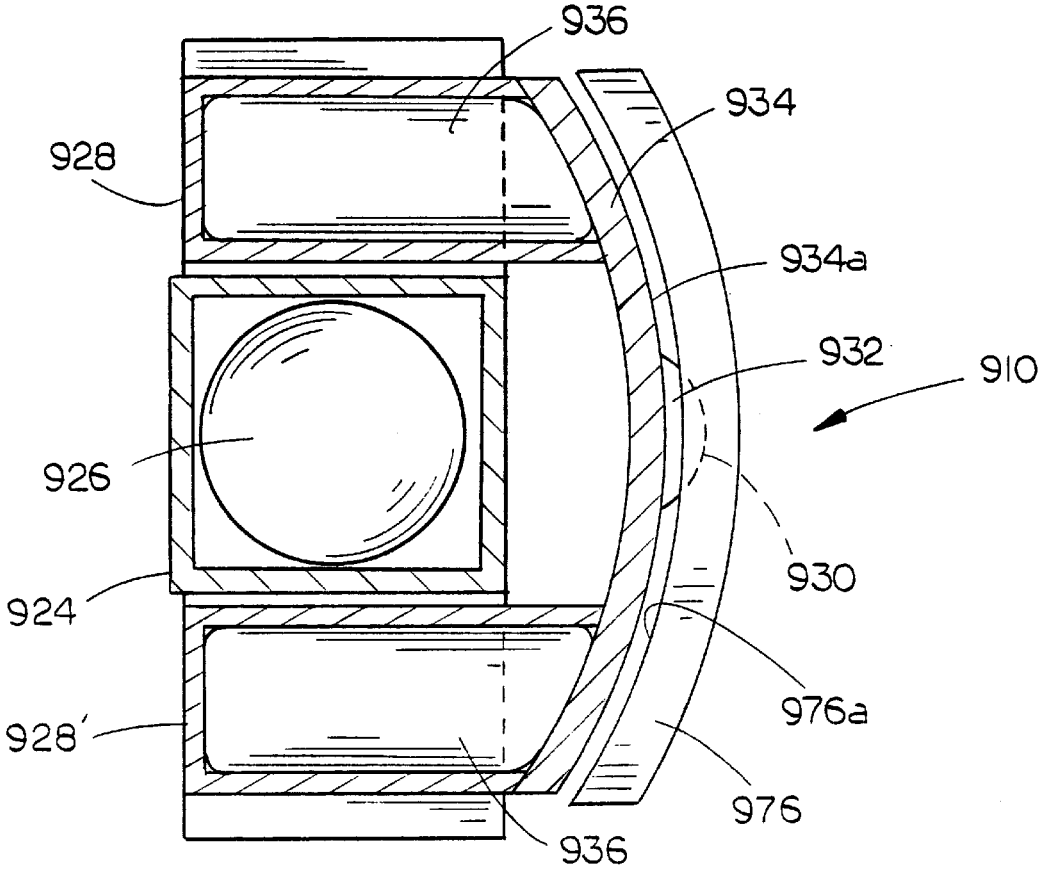
FIG. 21 is a top plan sectional view of a ninth embodiment to the invention.
Figure 22:
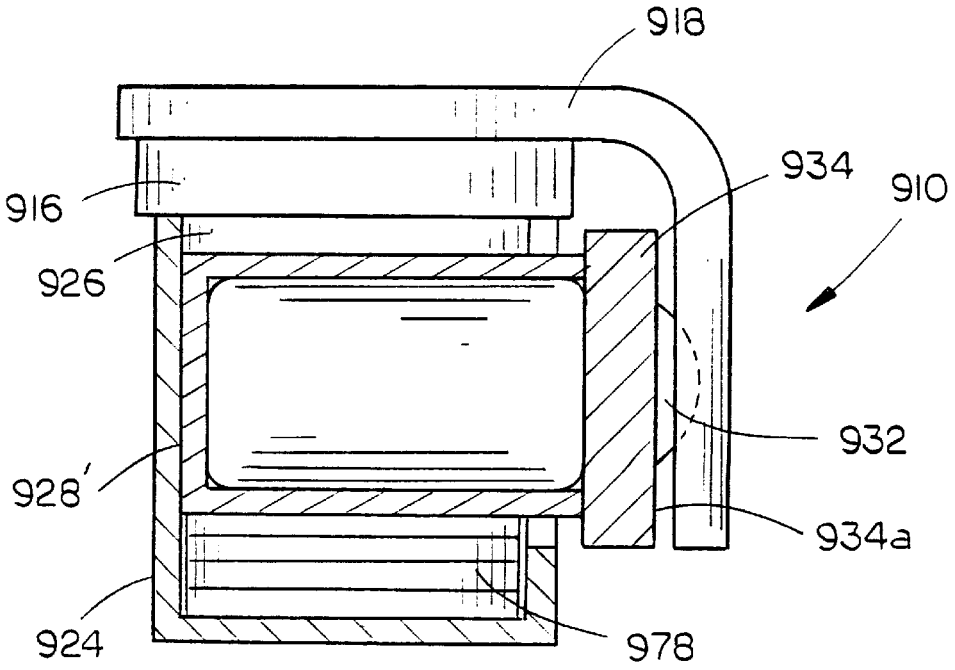
FIG. 22 is an end sectional view of the invention shown in FIG. 21.

Referring now to FIGS. 21 and 22, a ninth embodiment of the side bearing assembly is designated generally at 910. As shown in FIG. 21 a pair of horizontally oriented carriages 928 and 928' contain spring mechanisms 936 and 936' which will bias an elongated cam support member 934 extending between the two carriages 928 and 928'. A cam 932 may be formed on the outward surface 934*a* of cam support member 934 to engage a detent depression 930 formed on the inward surface 976*a* of the depending leg 976 of wear plate 918.

A central chamber between carriages 928 and 928' holds the top plate spring 926 to support top plate 916 above housing 924, as shown in FIG. 22. Preferably, each horizontal carriage 928 and 928' is also supported by springs 978 to provide "give" which would accommodate the rocking forces applied to wear plate 918.

Figure 23:
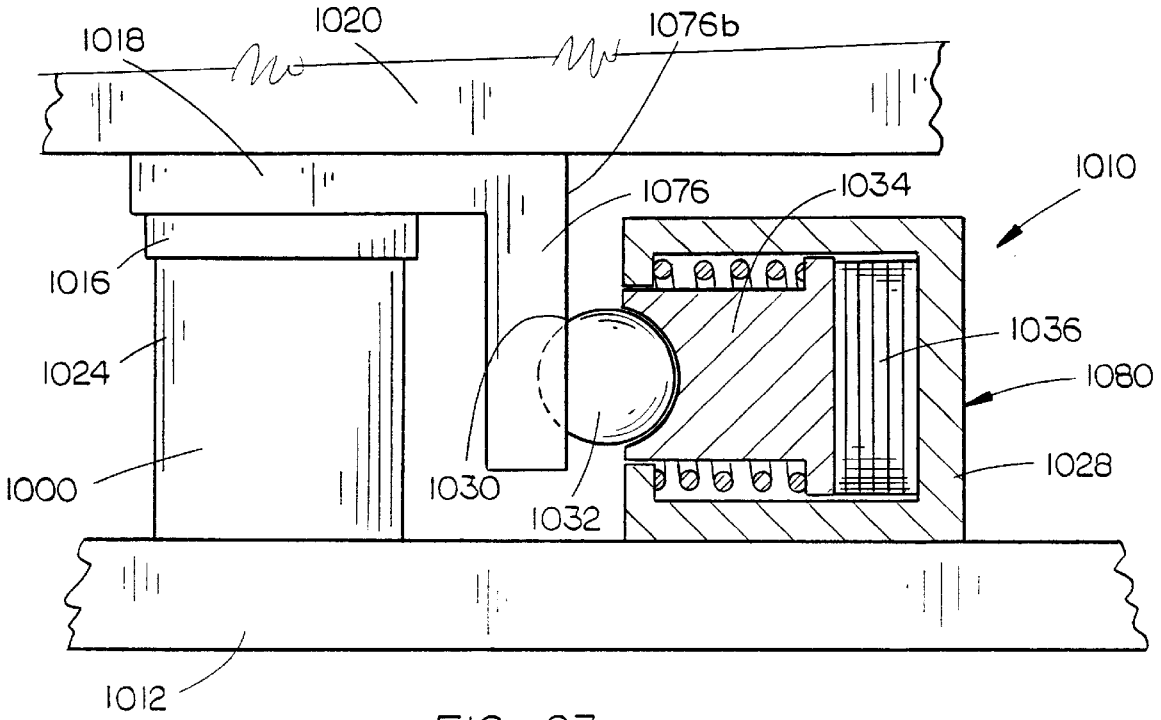
FIG. 23 is an end elevational view of a tenth embodiment of the invention.

FIG. 23 discloses a conventional constant contact side bearing CCSB 1000 mounted on bolster 1012 and incorporated with a centering mechanism 1080 (also on bolster 1012) to form a tenth embodiment of the invention, designated generally at 1010. The top plate 1016 on housing 1024 contacts the bottom surface of wear plate 1018, in a conventional fashion. Wear plate 1018 includes a depending wear plate leg 1076, with a detent depression 1030 formed in the curved outward surface 1076*b* of wear plate leg 1076. As with the previous versions of the side bearing assembly, wear plate leg 1076 is curved to a radius from the center of the pivotal joint of bolster 1012. Centering mechanism 1080 includes a carriage 1028 and cam spring mechanism 1036, both oriented horizontally and mounted on bolster 1012. The cam support member 1034 retains cam 1032 against the outward surface of wear plate leg 1076*b*.

An eleventh embodiment of the invention is designated at 1110 in FIG. 24 ard is quite similar to side bearing assembly 810, shown in FIGS. 18–20. Again, housing 1124 includes a top plate 1116 in contact with wear plate 1118 and a horizontally oriented carriage 1128 with a horizontally oriented cam spring mechanism 1136 therein. The cam support member 1134 is modified to retain cam 1132 adjacent the outward surface 1176*b* of wear plate depending leg 1176 (as opposed to the inward surface shown in the eighth embodiment of the invention of FIGS. 18–20). Spring mechanism 1136 differs only in the use of a biasing force which "pulls" the cam support member 1134, to maintain contact of cam 1132 with wear plate leg outer surface 1176*b*. Detent depression 1130 is formed on the outward curved surface of wear plate leg 1176*b*.

Figure 25:
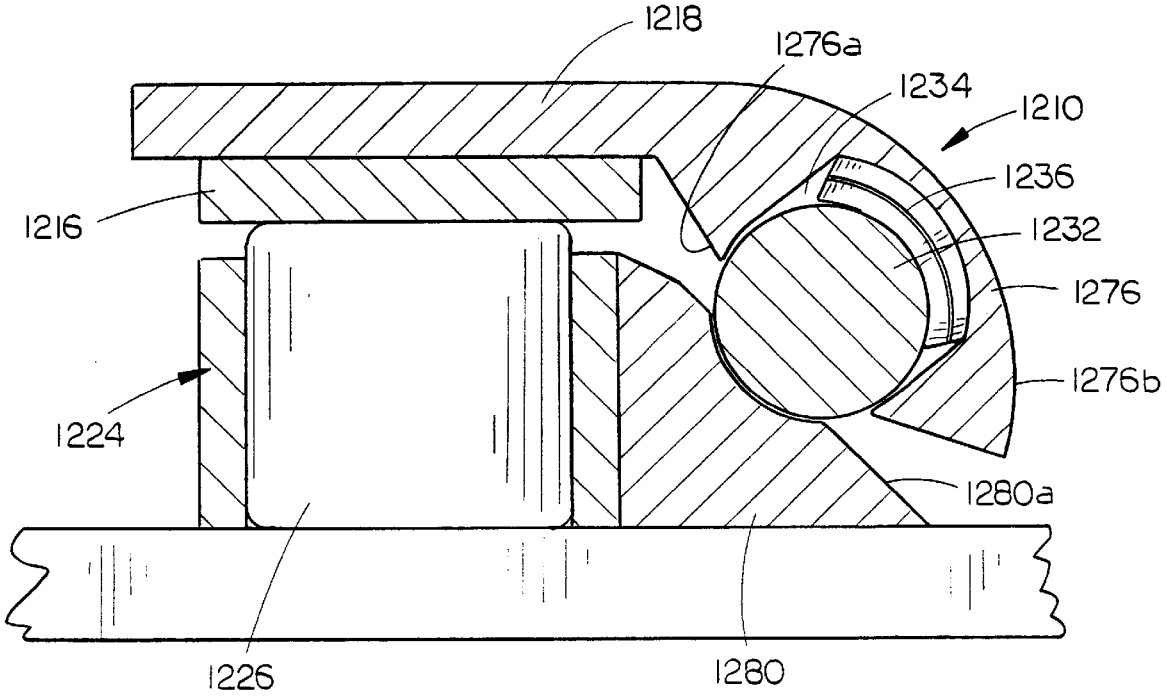
FIG. 25 is an end sectional view of a twelfth embodiment of the invention.
Figure 26:
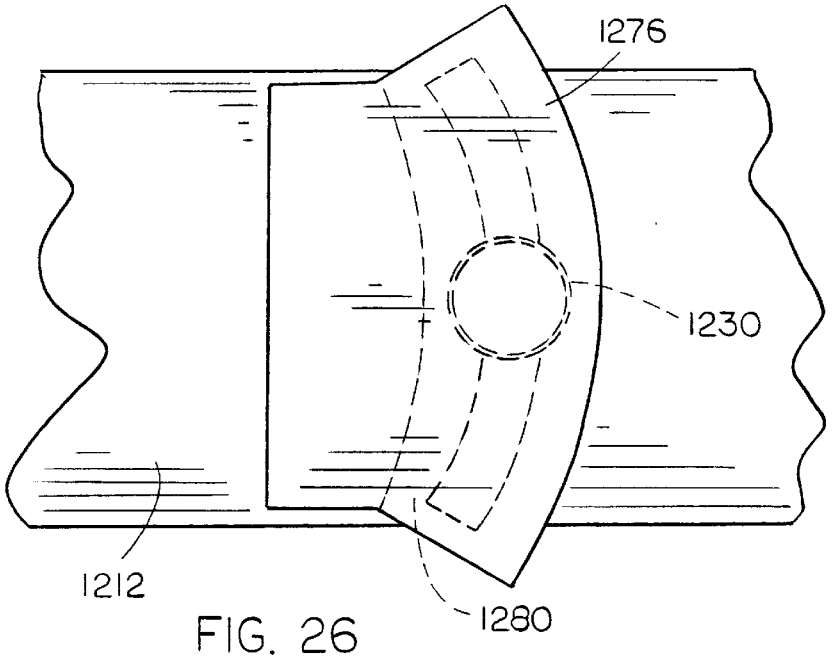
FIG. 26 is a top plan view of the invention shown in FIG. 25.

Referring now to FIG. 25, a twelfth embodiment of the side bearing assembler is designated generally at 1210 and includes a housing 1224 with carriage spring 1226 therein supporting a top plate 1216, which in turn frictionally contacts the lower surface of wear plate 1218. Wear plate 1218 includes a depending leg 1276 which includes an inwardly directed surface 1276*a* and an outwardly directly surface 1276*b*. A guide block 1280 is generally triangle in a cross-sectional shape, and includes an obliquely oriented outward surface 1280*a*. Guide 1280 is curved along a radius of the center of the bolster 1212, as shown in FIG. 26. Similarly, wear plate leg 1276 is curved along a radius of bolster 1212, to maintain a constant spaced relationship from guide 1280. A, detent depression 1230 is formed in the oblique outward surface 1280*a* of guide block 1280 and will receive cam 1232 to center the guide and bolster. Cam 1232 is biased against the outward surface 1280*a* of guide 1280 by a cam spring 1236 mounted within wear plate leg 1276. Similarly, cam 1232 is operably journaled within a cam support chamber 1234 formed on the inward surface 1276*a* of wear plate leg 1276.

Figure 27:
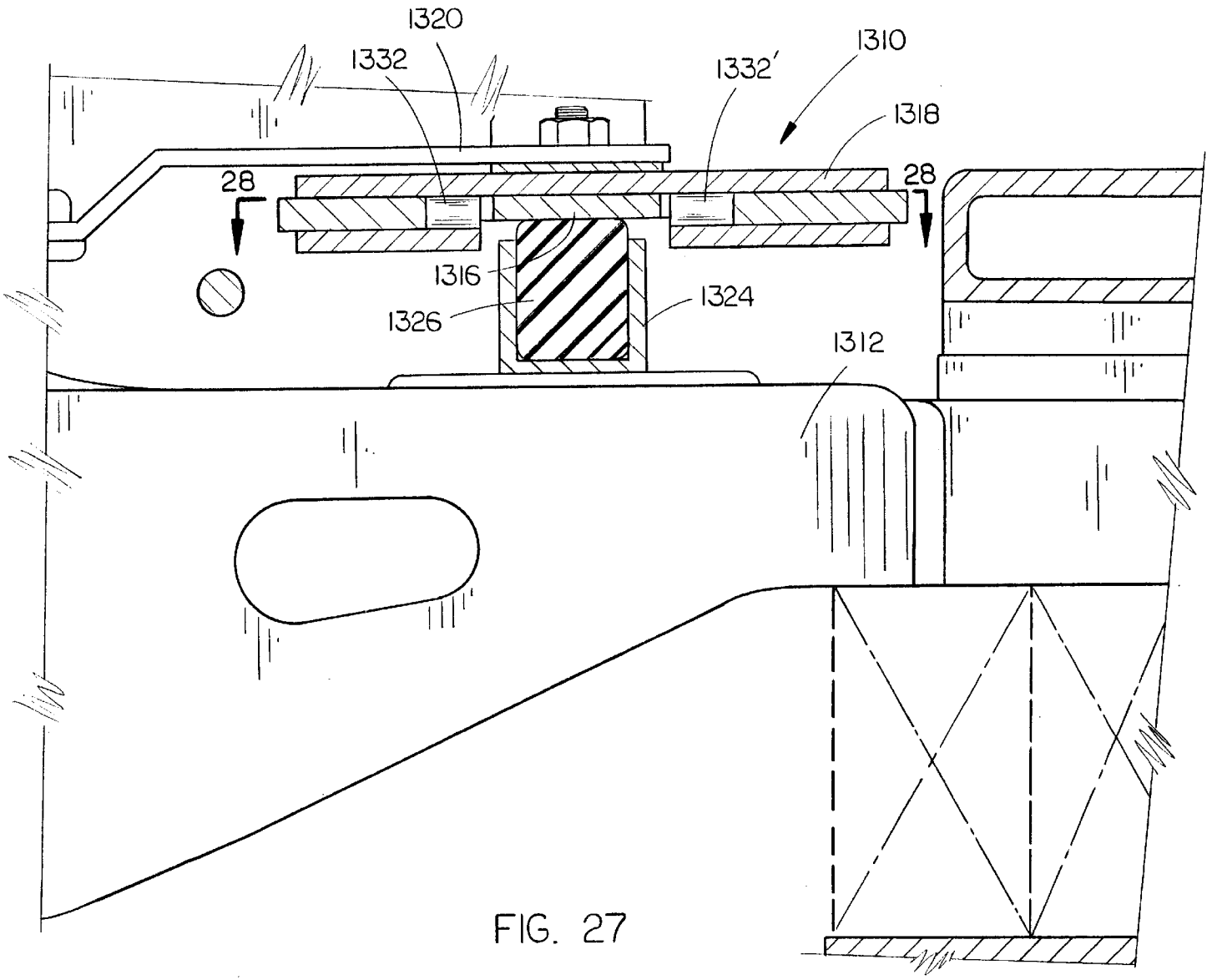
FIG. 27 is an end sectional view of a thirteenth embodiment of the invention.
Figure 28:
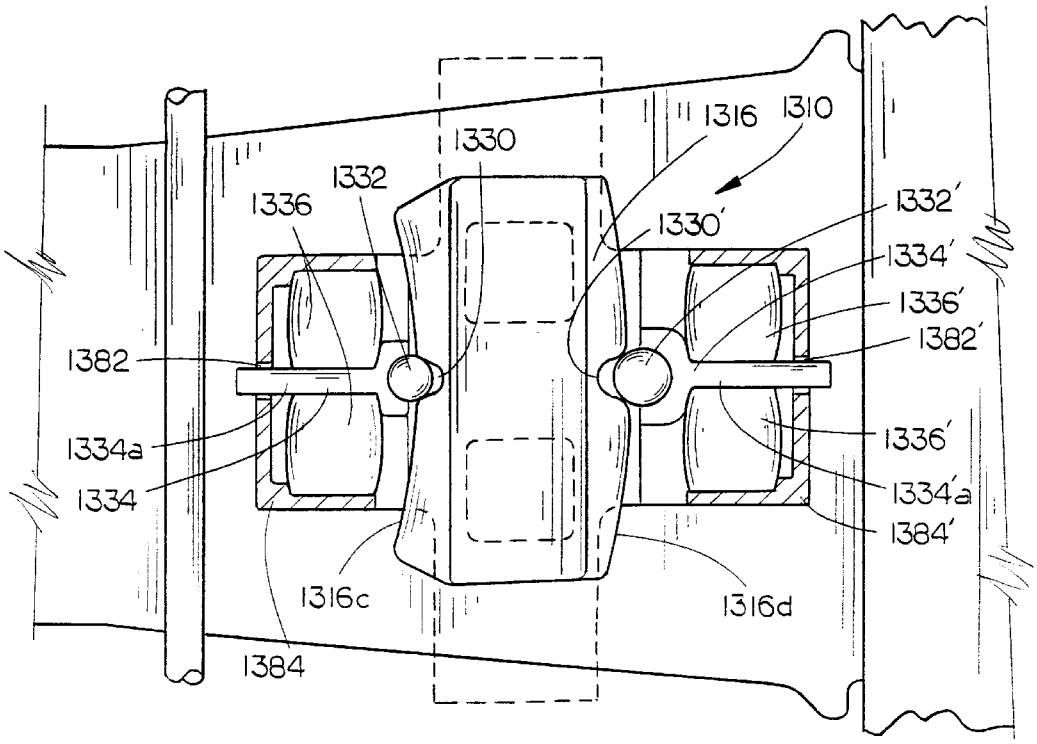
FIG. 28 is a top plan view taken at lines 28—28 in FIG. 27.

A thirteenth embodiment of the side bearing assembly is designated generally at 1310 in FIGS. 27 and 28. Housing 1324 is mounted on bolster 1312 and includes a carriage spring 1326 which supports top plate 1316. As shown in FIG. 28, top plate 1316 includes an inward edge 1316*c* and an opposing outward edge 1316*d*, edges 1316*c* and d being curved to a radius measured from the pivotal axis of bolster 1312. A pair of detent depressions 1330 and 1330' are radially aligned and centered on opposing edges 1316*c* and 1316*d*.

Wear plate 1318 is mounted to the bottom of car body 1320 with a portion in frictional contact with the upper surface of top plate 1316. A pair of cams 1332 and 1332' are carried on wear plate 1318 on opposing sides of top plate 1316. Cam support members 1334 and 1334' have a stem 1334*a* and 1334*a'* which is slidably journaled through a guide aperture 1382 and 1382' formed in a cam support housing 1384 and 1384' respectively. Cam spring mechanisms 1336 and 1336' bias the cam support members 1334 and 1334' so as to engage cams 1332 and 1332' with detent depressions 1330 and 1330'.

Figure 29:
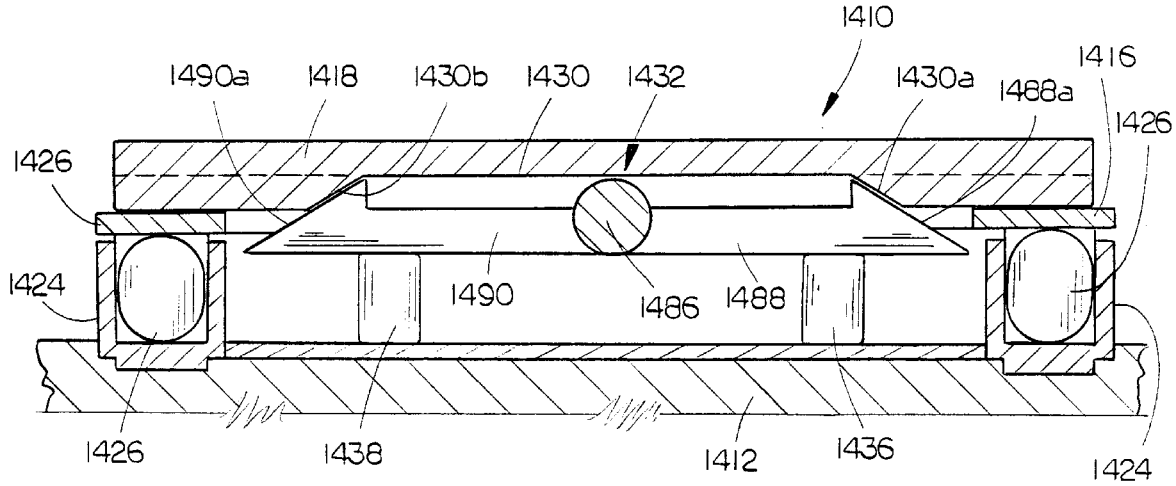
FIG. 29 is a side sectional view of a fourteenth embodiment of the invention.

Referring now to FIG. 29, a fourteenth embodiment of the side bearing assembly is designated generally at 1410 and includes a housing 1424 with a top plate 1416 supported by a plurality of carriage springs 1426. In this embodiment of the invention, the detent depression 1430 formed in the bottom surface of wear plate 1418 is an elongated depression with opposing sloped end walls 1430*a* and 1430*b*. Detent cam 1432 is an elongated member having a central hinge 1486 with one arm 1488 extending forwardly from the hinge and an opposing second arm 1490 extending rearwardly from the hinge. Hinge 1486 extends between side walls of housing 1424, and arms 1488 and 1490 are biased into a generally horizontal position by cam spring mechanisms 1436 and 1438 respectively.

It can be seen that movement of the truck bolster 1412 through a curve will cause wear plate 1418 to move generally longitudinally relative to the cam arms.

Each cam arm 1488 and 1490 includes an upper sloped bearing surface 1488*a* and 1490*a* respectively. Bearing surfaces 1488*a* and 1490*a* will contact the sloped side walls 1430*a* and 1430*b* of detent depression 1430 to center the truck bolster 1412 under wear plate 1418. During movement through a curve, either arm 1488 or arm 1490 will be pressed downwardly against the bias of the associated cam spring 1436 or 1438, depending upon the direction of rotation of the bolster on the curve.

Figure 30:
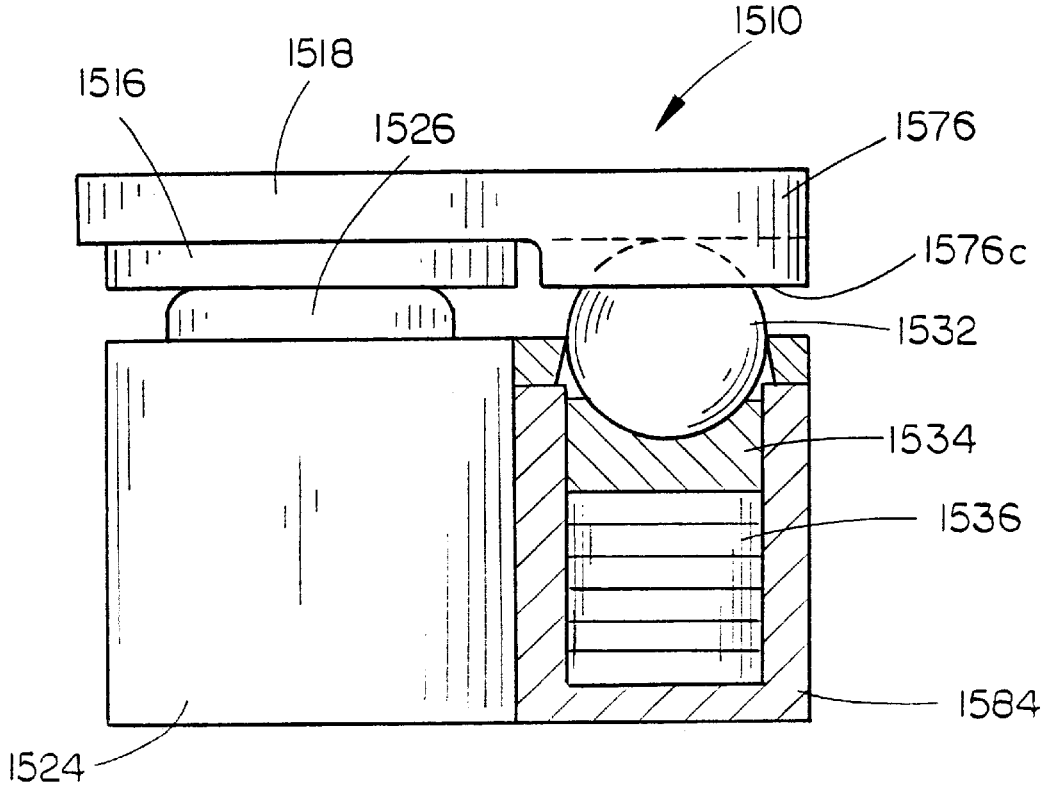
FIG. 30 is an end elevational view of a fifteenth embodiment of the invention.
Figure 31:
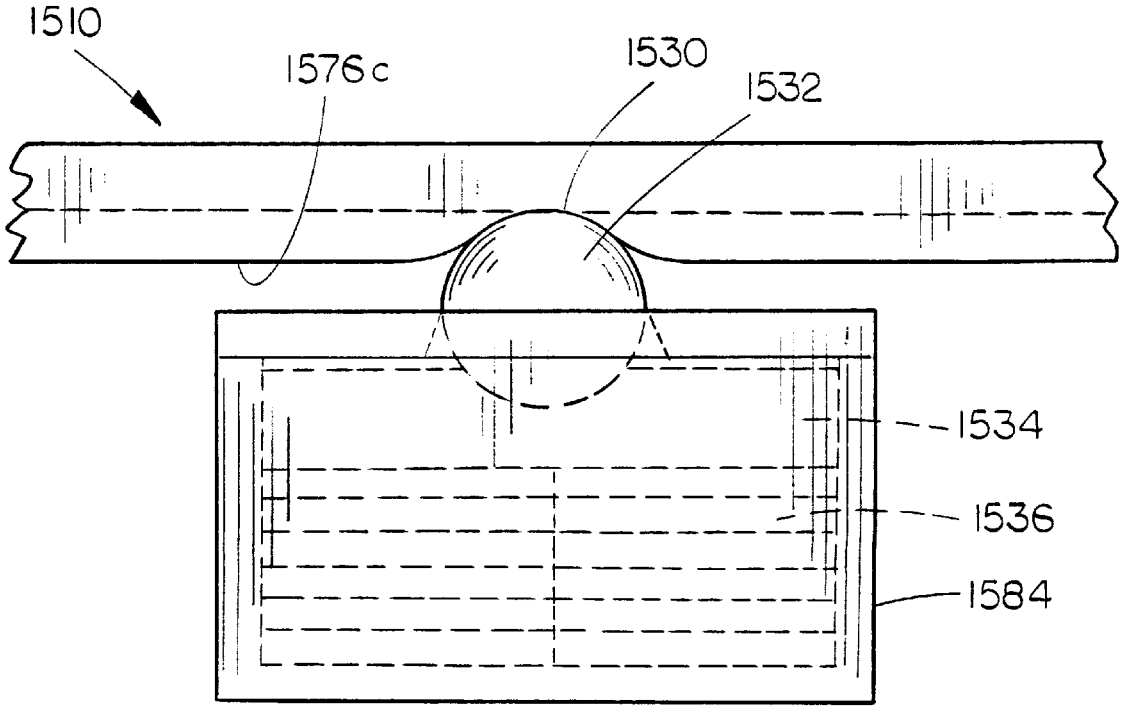
FIG. 31 is a side elevational view of the embodiment shown in FIG. 30.

A fifteenth embodiment of the invention is designated generally at 1510 in FIGS. 30 and 31. Housing 1524 retains carriage spring 1426 therein, which supports top plate 1416 in contact with wear plate 1418. In this embodiment of the invention, cam 1532 is laterally offset from housing 1524, with cam support member 1534 and spring mechanism 1536 in a separate and adjacent cam support housing 1584.

Wear plate 1518 includes a laterally offset leg 1576, which has a bottom surface 1576*c* with detent depression 1530 formed therein.

Figure 32:
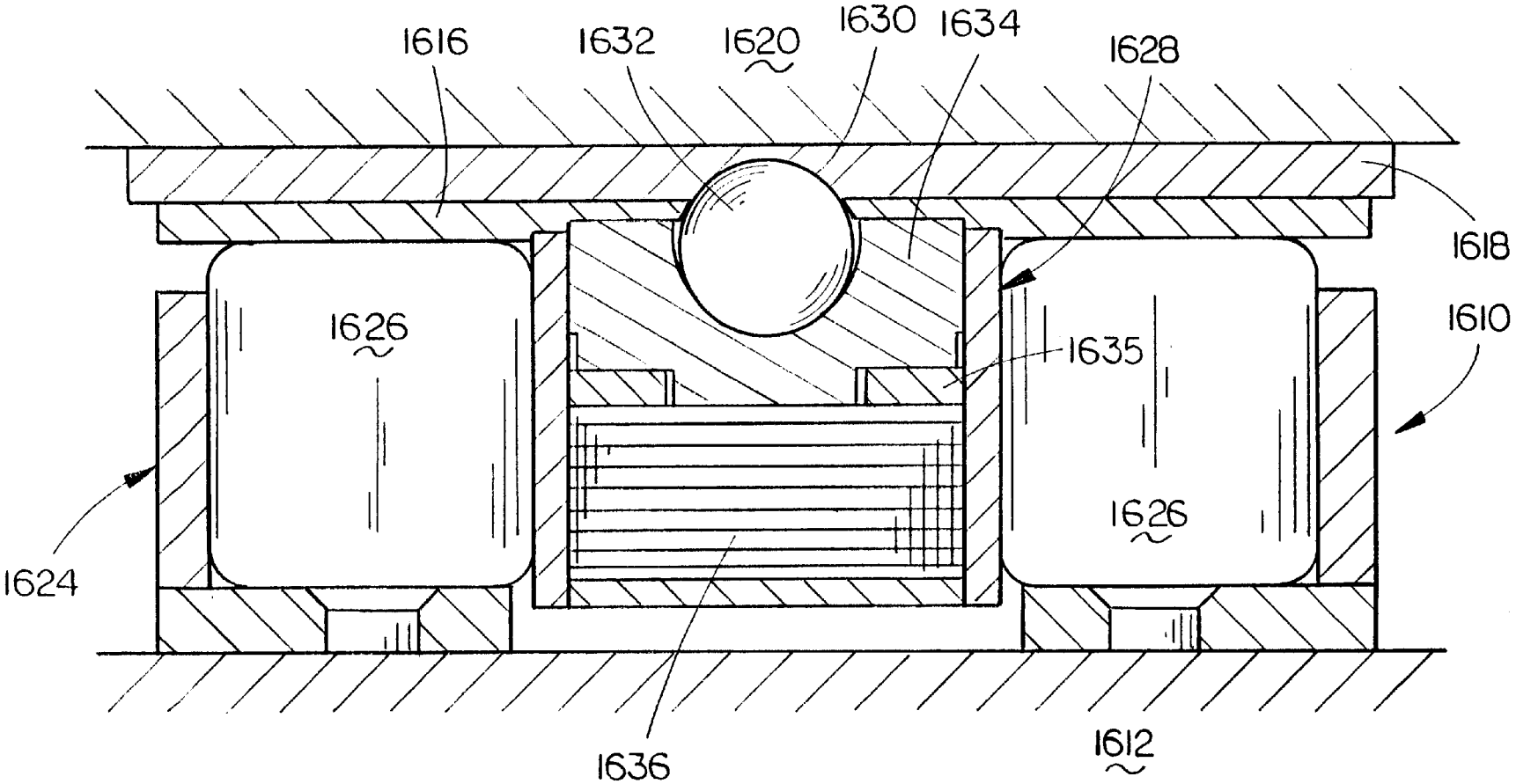
FIG. 32 is a side sectional view of a sixteenth embodiment of the invention.
Figure 33:
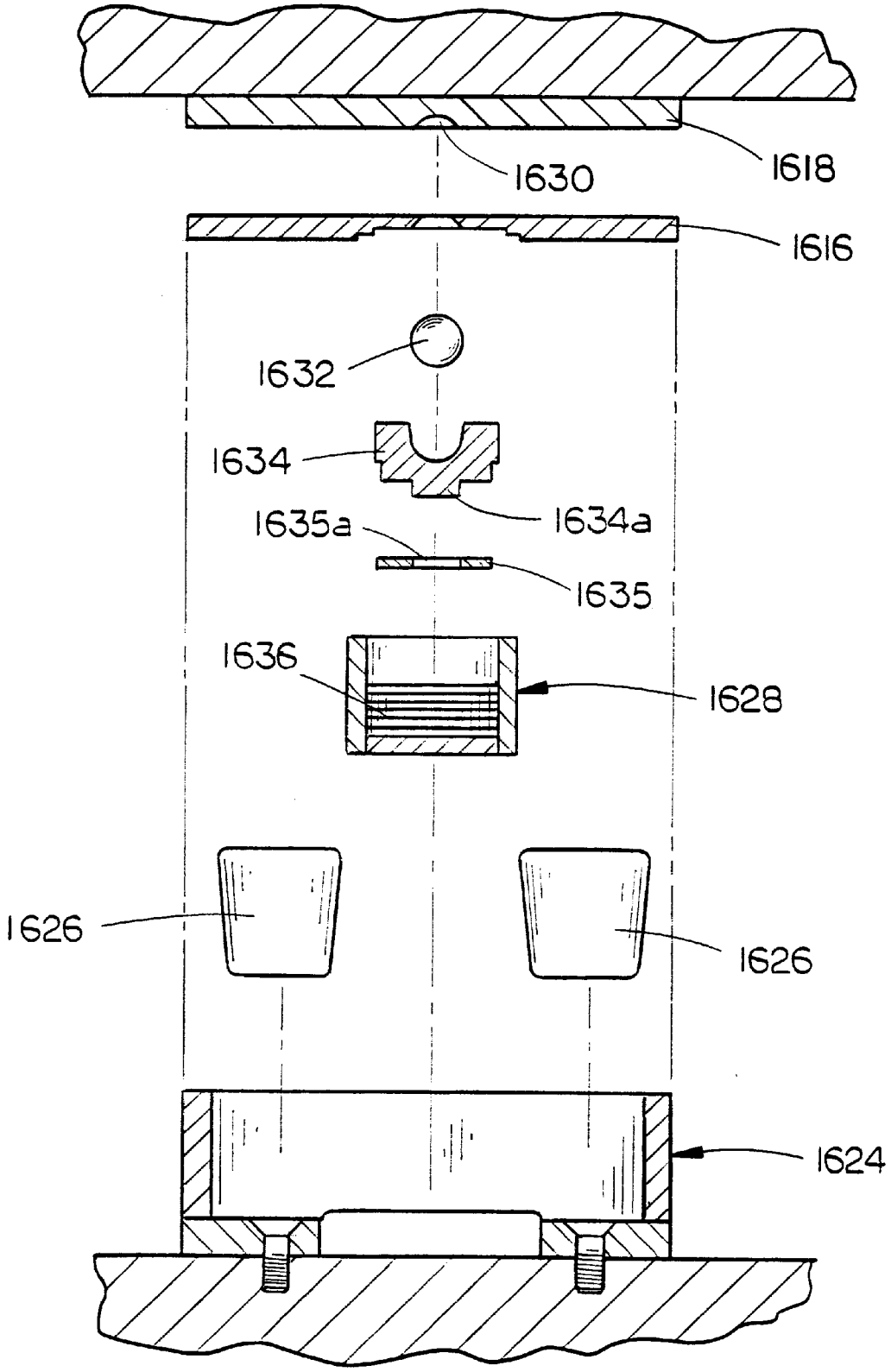
FIG. 33 is an exploded view of the sectional view of FIG. 32.

Referring now to FIGS. 32 and 33, a sixteenth embodiment of the side bearing assembly is designated generally at 1610 and includes a base housing 1624 mounted either on the bolster, or bottom of the rail car body, as discussed with respect to side bearing assembly 10. Side bearing assembly 1610 is a modification of the first embodiment of the invention shown in FIGS. 1–5. Base housing 1624 has an open upper end which will receive elastomeric compressible blocks 1626, as well as carriage 1628, the carriage depending from the bottom of top plate 1616. The upper face of top plate 1616 is in flush frictional engagement with the lower face of wear plate 1618.

In this sixteenth embodiment of the invention, the cam support member 1634 has a depending stem 1634*a* journaled through an aperture 1635*a* in a support ring 1635. Support ring 1635 rests atop the top spring mechanism 1636 within carriage 1628. Ring 1635 permits cam support member 1634 to pivot slightly within carriage 1628, while supporting support member 1634 on top of spring mechanism 1636.

As shown in FIG. 33, elastomeric blocks 1626 are preferably slightly truncated along the sides to permit easy insertion within housing 1624 on site. As weight is placed on top plate 1616, elastomeric blocks 1626 will be squeezed and expand outwardly to the orientation shown in FIG. 32 within housing 1624.

Whereas the invention has been shown and described in connection with the preferred embodiment thereof, many modifications, substitutions and additions may be made which are within the intended broad scope of the appended claims.

I claim:

1. In combination with a railway car comprising a car body, at least one wheeled truck bolster rotatably connected to the car body for rotation about a yaw axis, and a pair of side bearings on the truck bolster arranged diametric to the yaw axis, an apparatus for resisting truck hunting comprising a detent mechanism having:

a first portion mounted on the car body;

a second portion mounted on the truck bolster for movement therewith about the yaw axis;

a depression for receiving a cam located on one of said detent mechanism first or second portions;

a cam for selective engagement with said depression located on the other of said detent mechanism first or second portions; and a biasing device that applies constant force for biasing one of said cam and said first or second portion on which said depression is located toward one another, said biasing device resisting rotation of the bolster about the yaw axis from a predetermined position relative to the car body.

2. In combination:

a railway car having a car body with at least one wheeled truck with a bolster rotatably connected to the car body for rotation about a generally vertically oriented yaw axis; and a detent mechanism interposed between the car body and the bolster including a first portion having a depression formed therein, a second portion with an engagement member for selectively engaging the depression, and a biasing device that applies a substantially constant force for biasing one of said first and second portions toward the other, thereby resisting rotation of the bolster about the yaw axis from a predetermined position relative to the car body.

3. The combination of claim 2, wherein one of said detent mechanism first and second portions is mounted on the bolster for movement therewith and the other of said first and second portions is mounted on the car body.

4. The combination of claim 2, wherein said depression and said engagement member have cooperable shapes of predetermined design for providing predetermined truck hunting resistance force.

5. The combination of claim 2, further comprising a side bearing operably mounted between the bolster and car body with shock absorbing apparatus independent of the detent mechanism, for absorbing and dissipating shocks directed generally vertically between the car body and the bolster.

* * * * *